US009109423B2

(12) United States Patent
Dykstra et al.

(10) Patent No.: US 9,109,423 B2
(45) **Date of Patent: *Aug. 18, 2015**

(54) APPARATUS FOR AUTONOMOUS DOWNHOLE FLUID SELECTION WITH PATHWAY DEPENDENT RESISTANCE SYSTEM

(75) Inventors: Jason D. Dykstra, Carrollton, TX (US); Michael Linley Fripp, Carrollton, TX (US); Orlando DeJesus, Frisco, TX (US); John C. Gano, Carrollton, TX (US); Luke Holderman, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 764 days.

This patent is subject to a terminal disclaimer.

(21) Appl. No.: 12/700,685

(22) Filed: Feb. 4, 2010

(65) Prior Publication Data

US 2011/0186300 A1 Aug. 4, 2011
US 2011/0308806 A9 Dec. 22, 2011

Related U.S. Application Data

(63) Continuation-in-part of application No. 12/542,695, filed on Aug. 18, 2009, now abandoned.

(51) Int. Cl.
*E21B 34/08* (2006.01)
*F15C 1/16* (2006.01)
(Continued)

(52) U.S. Cl.
CPC ..... *E21B 34/08* (2013.01); *E21B 43/08* (2013.01); *E21B 43/12* (2013.01); *E21B 43/14* (2013.01); *E21B 43/32* (2013.01); *F15C 1/16* (2013.01)

(58) Field of Classification Search
CPC ..... E21B 34/08; E21B 43/12; E21B 43/14; E21B 43/32; F15C 1/04; F15C 1/16
USPC ..... 166/316; 137/806, 812, 813, 825
See application file for complete search history.

(56) References Cited

U.S. PATENT DOCUMENTS 553,727 A 1/1896 Van Sickle
1,329,559 A 2/1920 Tesla
(Continued)

FOREIGN PATENT DOCUMENTS

CN 2214518 12/1995
EP 0834342 A2 4/1998
(Continued)

OTHER PUBLICATIONS

Tesar, New Ways of Fluid Flow Control in Automobiles: Experience with Exhaust Gas Aftertreatment Control, Seoul 2000 FISITA World Automotive Congress, Jun. 12-15, 2000, F2000H192.
(Continued)

*Primary Examiner* — Robert E Fuller

(57) ABSTRACT

An apparatus is described for controlling flow of fluid in a tubular positioned in a wellbore extending through a subterranean formation. A flow control system is placed in fluid communication with a main tubular. The flow control system has a flow ratio control system and a pathway dependent resistance system. The flow ratio control system has a first and second passageway, the production fluid flowing into the passageways with the ratio of fluid flow through the passageways related to the characteristic of the fluid flow. The pathway dependent resistance system includes a vortex chamber with a first and second inlet and an outlet, the first inlet of the pathway dependent resistance system in fluid communication with the first passageway of the fluid ratio control system and the second inlet in fluid communication with the second passageway of the fluid ratio control system. The first inlet is positioned to direct fluid into the vortex chamber such that it flows primarily tangentially into the vortex chamber, and the second inlet is positioned to direct fluid such that it flows primarily radially into the vortex chamber. Undesired fluids, such as natural gas or water, in an oil well, are directed, based on their relative characteristic, into the vortex primarily tangentially, thereby restricting fluid flow when the undesired fluid is present as a component of the production fluid.

39 Claims, 23 Drawing Sheets

(51) Int. Cl.

| | |
|---|---|
| ***E21B 43/08*** | (2006.01) |
| ***E21B 43/12*** | (2006.01) |
| ***E21B 43/14*** | (2006.01) |
| ***E21B 43/32*** | (2006.01) |

(56) References Cited

U.S. PATENT DOCUMENTS

| | | | | | |
|---|---|---|---|---|---|
| 2,140,735 | A | | 12/1938 | Clarke | |
| 2,324,819 | A | | 6/1941 | Butzbach | |
| 2,762,437 | A | | 9/1956 | Egan | |
| 2,849,070 | A | | 8/1958 | Maly | |
| 2,945,541 | A | | 7/1960 | Maly | |
| 2,981,332 | A | | 4/1961 | Miller | |
| 2,981,333 | A | | 4/1961 | Miller | |
| 3,091,393 | A | | 5/1963 | Sparrow | |
| 3,186,484 | A | | 6/1965 | Waterman | |
| 3,209,774 | A | | 10/1965 | Manion | |
| 3,216,439 | A | | 11/1965 | Manion | |
| 3,233,621 | A | | 2/1966 | Manion | |
| 3,233,622 | A | | 2/1966 | Boothe | |
| 3,256,899 | A | | 6/1966 | Dexter | |
| 3,266,510 | A | | 8/1966 | Wadey | |
| 3,267,946 | A | * | 8/1966 | Adams et al. | 137/813 |
| 3,282,279 | A | | 11/1966 | Manion | |
| 3,375,842 | A | | 4/1968 | Reader | |
| 3,427,580 | A | | 2/1969 | Brock | |
| 3,461,897 | A | | 8/1969 | Kwok | |
| 3,470,894 | A | | 10/1969 | Rimmer | |
| 3,474,670 | A | | 10/1969 | Rupert | |
| 3,477,506 | A | | 11/1969 | Malone | |
| 3,486,975 | A | | 12/1969 | Ripley | |
| 3,489,009 | A | | 1/1970 | Rimmer | |
| 3,515,160 | A | | 6/1970 | Cohen | |
| 3,521,657 | A | * | 7/1970 | Ayers | 137/813 |
| 3,529,614 | A | | 9/1970 | Nelson | |
| 3,537,466 | A | | 11/1970 | Chapin | |
| 3,554,209 | A | | 1/1971 | Brown | |
| 3,566,900 | A | | 3/1971 | Black | |
| 3,575,804 | A | | 4/1971 | Ripley | |
| 3,586,104 | A | | 6/1971 | Hyde | |
| 3,598,137 | A | | 8/1971 | Glaze | |
| 3,620,238 | A | | 11/1971 | Kawahata | |
| 3,638,672 | A | * | 2/1972 | Smith et al. | 137/813 |
| 3,643,676 | A | * | 2/1972 | Limage et al. | 137/15.2 |
| 3,670,753 | A | | 6/1972 | Healey | |
| 3,704,832 | A | | 12/1972 | Fix | |
| 3,712,321 | A | | 1/1973 | Bauer | |
| 3,717,164 | A | | 2/1973 | Griffin | |
| 3,730,673 | A | | 5/1973 | Straitz | |
| 3,745,115 | A | | 7/1973 | Olsen | |
| 3,754,576 | A | | 8/1973 | Zettrestrom | |
| 3,756,285 | A | * | 9/1973 | Johnson et al. | 137/810 |
| 3,776,460 | A | | 12/1973 | Fichter | |
| 3,850,190 | A | | 11/1974 | Carlson | |
| 3,860,519 | A | | 1/1975 | Weatherford | |
| 3,876,016 | A | | 4/1975 | Stinson | |
| 3,885,627 | A | | 5/1975 | Berry et al. | |
| 3,895,901 | A | | 7/1975 | Schwartz | |
| 3,927,849 | A | | 12/1975 | Kovalenko | |
| 3,942,557 | A | | 3/1976 | Tsuchiya | |
| 4,003,405 | A | | 1/1977 | Hayes | |
| 4,029,127 | A | | 6/1977 | Thompson | |
| 4,082,169 | A | | 4/1978 | Bowles | |
| 4,108,721 | A | * | 8/1978 | Drzewiecki et al. | 376/230 |
| 4,127,173 | A | | 11/1978 | Watkins | |
| 4,134,100 | A | | 1/1979 | Funke | |
| 4,138,669 | A | | 2/1979 | Edison | |
| 4,167,073 | A | | 9/1979 | Tang | |
| 4,167,873 | A | | 9/1979 | Bahrton | |
| 4,187,909 | A | | 2/1980 | Erbstoesser | |
| 4,268,245 | A | | 5/1981 | Straitz, III | |
| 4,276,943 | A | | 7/1981 | Holmes | |
| 4,279,304 | A | | 7/1981 | Harper | |
| 4,282,097 | A | | 8/1981 | Kuepper | |
| 4,286,627 | A | | 9/1981 | Graf | |
| 4,287,952 | A | | 9/1981 | Erbstoesser | |
| 4,291,395 | A | | 9/1981 | Holmes | |
| 4,303,128 | A | | 12/1981 | Marr, Jr. | |
| 4,307,204 | A | | 12/1981 | Vidal | |
| 4,307,653 | A | | 12/1981 | Goes | |
| 4,323,118 | A | | 4/1982 | Bergmann | |
| 4,323,991 | A | | 4/1982 | Holmes | |
| 4,345,650 | A | | 8/1982 | Wesley | |
| 4,364,232 | A | | 12/1982 | Sheinbaum | |
| 4,364,587 | A | | 12/1982 | Samford | |
| 4,385,875 | A | | 5/1983 | Kanazawa | |
| 4,390,062 | A | | 6/1983 | Fox | |
| 4,393,928 | A | | 7/1983 | Warnock, Sr. | |
| 4,396,062 | A | | 8/1983 | Iskander | |
| 4,418,721 | A | | 12/1983 | Holmes | |
| 4,442,903 | A | | 4/1984 | Schutt | |
| 4,467,833 | A | | 8/1984 | Satterwhite | |
| 4,485,780 | A | | 12/1984 | Price | |
| 4,491,186 | A | | 1/1985 | Alder | |
| 4,495,990 | A | | 1/1985 | Titus | |
| 4,518,013 | A | | 5/1985 | Lazarus | |
| 4,526,667 | A | | 7/1985 | Parkhurst | |
| 4,527,636 | A | | 7/1985 | Bordon | |
| 4,557,295 | A | | 12/1985 | Holmes | |
| 4,562,867 | A | | 1/1986 | Stouffer | |
| 4,570,675 | A | | 2/1986 | Fenwick | |
| 4,570,715 | A | | 2/1986 | Van Meurs | |
| 4,618,197 | A | | 10/1986 | White | |
| 4,648,455 | A | | 3/1987 | Luke | |
| 4,716,960 | A | | 1/1988 | Eastlund | |
| 4,747,451 | A | | 5/1988 | Adams | |
| 4,765,184 | A | | 8/1988 | Delatore | |
| 4,801,310 | A | | 1/1989 | Bielefeldt | |
| 4,805,407 | A | | 2/1989 | Buchanan | |
| 4,808,084 | A | | 2/1989 | Tsubouchi | |
| 4,817,863 | A | * | 4/1989 | Bragg et al. | 236/49.4 |
| 4,846,224 | A | | 7/1989 | Collins, Jr. | |
| 4,848,991 | A | | 7/1989 | Bielefeldt | |
| 4,895,582 | A | | 1/1990 | Bielefeldt | |
| 4,911,239 | A | | 3/1990 | Winckler | |
| 4,919,201 | A | | 4/1990 | Bridges | |
| 4,919,204 | A | | 4/1990 | Baker | |
| 4,921,438 | A | | 5/1990 | Godfrey | |
| 4,945,995 | A | | 8/1990 | Tholance | |
| 4,967,048 | A | | 10/1990 | Langston | |
| 4,974,674 | A | | 12/1990 | Wells | |
| 4,984,594 | A | | 1/1991 | Vinegar | |
| 4,998,585 | A | | 3/1991 | Newcomer | |
| RE33,690 | E | | 9/1991 | Adams, Jr. | |
| 5,058,683 | A | | 10/1991 | Godfrey | |
| 5,076,327 | A | | 12/1991 | Mettner | |
| 5,080,783 | A | | 1/1992 | Brown | |
| 5,099,918 | A | | 3/1992 | Bridges | |
| 5,154,835 | A | | 10/1992 | Demichael | |
| 5,165,450 | A | | 11/1992 | Marrelli | |
| 5,166,677 | A | | 11/1992 | Schoenberg | |
| 5,184,678 | A | | 2/1993 | Pechkov | |
| 5,202,194 | A | | 4/1993 | Vanberg | |
| 5,207,273 | A | | 5/1993 | Cates | |
| 5,207,274 | A | | 5/1993 | Streich | |
| 5,228,508 | A | | 7/1993 | Facteau | |
| 5,251,703 | A | | 10/1993 | Skinner | |
| 5,279,363 | A | | 1/1994 | Schultz et al. | |
| 5,282,508 | A | | 2/1994 | Ellingsen | |
| 5,303,782 | A | | 4/1994 | Johannessen | |
| 5,332,035 | A | | 7/1994 | Schultz | |
| 5,333,684 | A | | 8/1994 | Walter | |
| 5,337,808 | A | | 8/1994 | Graham | |
| 5,337,821 | A | | 8/1994 | Peterson | |
| 5,338,496 | A | | 8/1994 | Talbot | |
| 5,341,883 | A | | 8/1994 | Ringgenberg | |
| 5,343,963 | A | | 9/1994 | Bouldin | |
| 5,375,658 | A | | 12/1994 | Schultz | |
| 5,435,393 | A | | 7/1995 | Brekke | |
| 5,455,804 | A | | 10/1995 | Holmes | |
| 5,464,059 | A | | 11/1995 | Kristiansen | |
| 5,482,117 | A | | 1/1996 | Kolpak | |
| 5,484,016 | A | | 1/1996 | Surjaatmadja | |
| 5,505,262 | A | | 4/1996 | Cobb | |

(56) References Cited

U.S. PATENT DOCUMENTS 5,516,603 A 5/1996 Holcombe
5,533,571 A 7/1996 Surjaatmadja
5,547,029 A 8/1996 Rubbo
5,570,744 A 11/1996 Weingarten
5,578,209 A 11/1996 Weiss
5,673,751 A 10/1997 Head
5,815,370 A * 9/1998 Sutton ..... 361/699
5,839,508 A 11/1998 Tubel
5,868,201 A 2/1999 Bussear
5,893,383 A 4/1999 Facteau
5,896,076 A 4/1999 van Namen
6,015,011 A 1/2000 Hunter
6,032,733 A 3/2000 Ludwig
6,078,471 A 6/2000 Fiske
6,098,020 A 8/2000 DenBoer
6,109,370 A 8/2000 Gray
6,109,372 A 8/2000 Dorel et al.
6,112,817 A 9/2000 Voll
6,164,375 A 12/2000 Carisella
6,176,308 B1 1/2001 Pearson
6,179,052 B1 1/2001 Purkis
6,247,536 B1 6/2001 Leismer
6,315,043 B1 11/2001 Farrant
6,315,049 B1 11/2001 Hickey
6,320,238 B1 11/2001 Kawabata
6,345,963 B1 2/2002 Thomin
6,367,547 B1 4/2002 Towers et al.
6,371,210 B1 4/2002 Bode et al.
6,397,950 B1 6/2002 Streich
6,426,917 B1 7/2002 Tabanou
6,433,991 B1 8/2002 Deaton
6,450,263 B1 9/2002 Schwendemann
6,464,011 B2 10/2002 Tubel
6,470,970 B1 10/2002 Purkis
6,497,252 B1 12/2002 Kohler
6,540,263 B1 4/2003 Sausner
6,544,691 B1 4/2003 Guidotti
6,547,010 B2 4/2003 Hensley
6,567,013 B1 5/2003 Purkis
6,575,237 B2 6/2003 Purkis
6,575,248 B2 6/2003 Zhang
6,585,051 B2 7/2003 Purkis
6,622,794 B2 9/2003 Zisk, Jr.
6,627,081 B1 9/2003 Hilditch et al.
6,644,412 B2 11/2003 Bode et al.
6,668,936 B2 12/2003 Williamson, Jr.
6,672,382 B2 1/2004 Schultz
6,679,332 B2 1/2004 Vinegar
6,691,781 B2 2/2004 Grant et al.
6,705,085 B1 3/2004 Braithwaite
6,719,048 B1 4/2004 Ramos et al.
6,725,925 B2 4/2004 Al-Ramadhan
6,812,811 B2 11/2004 Robison
6,834,725 B2 12/2004 Whanger
6,840,325 B2 1/2005 Stephenson
6,851,473 B2 2/2005 Davidson
6,851,560 B2 2/2005 Reig
6,857,475 B2 2/2005 Johnson
6,857,476 B2 2/2005 Richards
6,886,634 B2 5/2005 Richards
6,907,937 B2 6/2005 Whanger
6,913,079 B2 7/2005 Tubel
6,935,432 B2 8/2005 Nguyen
6,957,703 B2 10/2005 Trott
6,958,704 B2 10/2005 Vinegar
6,967,589 B1 11/2005 Peters
6,976,507 B1 12/2005 Webb
7,007,756 B2 3/2006 Lerche
7,011,101 B2 3/2006 Bowe
7,011,152 B2 3/2006 Soelvik
7,013,979 B2 3/2006 Richard
7,017,662 B2 3/2006 Schultz
7,025,134 B2 4/2006 Byrd
7,038,332 B2 5/2006 Robison et al.
7,040,391 B2 5/2006 Leuthen
7,043,937 B2 5/2006 Lifson
7,059,401 B2 6/2006 Bode
7,063,162 B2 6/2006 Oaling
7,066,261 B2 6/2006 Vicente
7,096,945 B2 8/2006 Richards
7,100,686 B2 9/2006 Wittrisch
7,108,083 B2 9/2006 Simonds
7,114,560 B2 10/2006 Nguyen
7,143,832 B2 12/2006 Freyer
7,168,494 B2 1/2007 Starr
7,185,706 B2 3/2007 Freyer et al.
7,199,480 B2 4/2007 Fripp
7,207,386 B2 4/2007 Brannon
7,213,650 B2 5/2007 Lehman
7,213,681 B2 5/2007 Birchak
7,216,738 B2 5/2007 Birchak
7,258,169 B2 8/2007 Fripp
7,290,606 B2 11/2007 Coronado et al.
7,318,471 B2 1/2008 Rodney
7,322,409 B2 1/2008 Wittle
7,322,416 B2 1/2008 Burris
7,350,577 B2 4/2008 Howard
7,363,967 B2 4/2008 Burris
7,404,416 B2 7/2008 Schultz
7,405,998 B2 7/2008 Webb
7,409,999 B2 8/2008 Henriksen et al.
7,413,010 B2 8/2008 Blauch
7,419,002 B2 9/2008 Oybevik
7,426,962 B2 9/2008 Moen
7,440,283 B1 10/2008 Rafie
7,455,104 B2 11/2008 Duhon
7,464,609 B2 12/2008 Fallet
7,468,890 B2 12/2008 Lin
7,469,743 B2 12/2008 Richards
7,520,321 B2 4/2009 Hiron
7,537,056 B2 5/2009 MacDougall
7,578,343 B2 8/2009 Augustine
7,621,336 B2 11/2009 Badalamenti
7,644,773 B2 1/2010 Richard
7,686,078 B2 3/2010 Khomynets
7,699,102 B2 4/2010 Storm
7,708,068 B2 5/2010 Hailey, Jr.
7,780,152 B2 8/2010 Rao
7,814,973 B2 10/2010 Dusterhoft
7,828,067 B2 11/2010 Scott
7,857,050 B2 12/2010 Zazovsky
7,857,061 B2 12/2010 Richards
7,882,894 B2 2/2011 Nguyen
7,918,272 B2 4/2011 Gaudette
8,016,030 B1 9/2011 Prado Garcia
8,025,103 B1 9/2011 Wolinsky
8,083,935 B2 12/2011 Eia
8,127,856 B1 3/2012 Nish
8,191,627 B2 6/2012 Hamid
8,196,665 B2 6/2012 Wolinsky
8,235,128 B2 8/2012 Dykstra
8,261,839 B2 9/2012 Fripp
8,272,443 B2 9/2012 Watson
8,276,669 B2 10/2012 Dykstra
8,302,696 B2 11/2012 Williams et al.
2002/0148607 A1 10/2002 Pabst
2002/0150483 A1 10/2002 Ursan
2003/0173086 A1 9/2003 Howard
2004/0011561 A1 1/2004 Hughes
2005/0110217 A1 5/2005 Wood
2005/0150657 A1 7/2005 Howard
2005/0173351 A1 8/2005 Neofotistos
2005/0214147 A1 9/2005 Schultz
2006/0076150 A1 4/2006 Coronado
2006/0113089 A1 6/2006 Henriksen
2006/0131033 A1 6/2006 Bode
2006/0185849 A1 8/2006 Edwards
2007/0012454 A1 1/2007 Ross
2007/0028977 A1 * 2/2007 Goulet ..... 137/809
2007/0045038 A1 3/2007 Han
2007/0107719 A1 5/2007 Blacker
2007/0169942 A1 7/2007 Loretz
2007/0173397 A1 7/2007 Hinman
2007/0193752 A1 8/2007 Kim

(56) References Cited

U.S. PATENT DOCUMENTS

| | | | |
|---|---|---|---|
| 2007/0246225 | A1 | 10/2007 | Hailey |
| 2007/0246407 | A1 | 10/2007 | Richards |
| 2007/0256828 | A1 | 11/2007 | Birchak |
| 2008/0035330 | A1 | 2/2008 | Richards |
| 2008/0041580 | A1 | 2/2008 | Freyer |
| 2008/0041581 | A1 | 2/2008 | Richards |
| 2008/0041582 | A1 | 2/2008 | Saetre |
| 2008/0041588 | A1 | 2/2008 | Richards |
| 2008/0149323 | A1 | 6/2008 | O'Malley |
| 2008/0169099 | A1 | 7/2008 | Pensgaard |
| 2008/0236839 | A1 | 10/2008 | Oddie |
| 2008/0251255 | A1 | 10/2008 | Forbes |
| 2008/0261295 | A1 | 10/2008 | Butler |
| 2008/0283238 | A1 | 11/2008 | Richards |
| 2008/0314578 | A1 | 12/2008 | Jackson |
| 2008/0314590 | A1 | 12/2008 | Patel |
| 2009/0000787 | A1 | 1/2009 | Hill |
| 2009/0008088 | A1 | 1/2009 | Schultz |
| 2009/0008090 | A1 | 1/2009 | Schultz |
| 2009/0009297 | A1 | 1/2009 | Shinohara |
| 2009/0009333 | A1 | 1/2009 | Bhogal |
| 2009/0009336 | A1 | 1/2009 | Ishikawa |
| 2009/0009412 | A1 | 1/2009 | Warther |
| 2009/0009437 | A1 | 1/2009 | Hwang |
| 2009/0009445 | A1 | 1/2009 | Lee |
| 2009/0009447 | A1 | 1/2009 | Naka |
| 2009/0020292 | A1 | 1/2009 | Loretz |
| 2009/0065197 | A1 | 3/2009 | Eslinger |
| 2009/0078427 | A1 | 3/2009 | Patel |
| 2009/0078428 | A1 | 3/2009 | Ali |
| 2009/0101342 | A1 | 4/2009 | Gaudette |
| 2009/0101344 | A1 | 4/2009 | Crow |
| 2009/0101352 | A1 | 4/2009 | Coronado |
| 2009/0101354 | A1 | 4/2009 | Holmes |
| 2009/0114395 | A1 | 5/2009 | Holmes |
| 2009/0120647 | A1 | 5/2009 | Turick |
| 2009/0133869 | A1 | 5/2009 | Clem |
| 2009/0145609 | A1 | 6/2009 | Holmes et al. |
| 2009/0151925 | A1 | 6/2009 | Richards |
| 2009/0159282 | A1 | 6/2009 | Webb |
| 2009/0188661 | A1 | 7/2009 | Bizon |
| 2009/0205834 | A1 | 8/2009 | Garcia et al. |
| 2009/0218103 | A1 | 9/2009 | Aakre |
| 2009/0226301 | A1 | 9/2009 | Priestman et al. |
| 2009/0236102 | A1 | 9/2009 | Guest et al. |
| 2009/0250224 | A1 | 10/2009 | Wright et al. |
| 2009/0277639 | A1 | 11/2009 | Schultz |
| 2009/0277650 | A1 | 11/2009 | Casciaro |
| 2009/0301730 | A1 | 12/2009 | Gweily |
| 2010/0025045 | A1 | 2/2010 | Lake |
| 2010/0122804 | A1 | 5/2010 | Yang |
| 2010/0175867 | A1 | 7/2010 | Wright |
| 2010/0181251 | A1 | 7/2010 | Alspektor |
| 2010/0249723 | A1 | 9/2010 | Fangrow, Jr. |
| 2010/0300568 | A1 | 12/2010 | Faram |
| 2011/0017458 | A1 | 1/2011 | East |
| 2011/0042091 | A1 | 2/2011 | Dykstra |
| 2011/0042092 | A1 | 2/2011 | Fripp |
| 2011/0042323 | A1 | 2/2011 | Sullivan |
| 2011/0079384 | A1 | 4/2011 | Russell et al. |
| 2011/0139451 | A1 | 6/2011 | McKeen et al. |
| 2011/0139453 | A1 | 6/2011 | Schultz |
| 2011/0186300 | A1 | 8/2011 | Dykstra et al. |
| 2011/0198097 | A1 | 8/2011 | Moen |
| 2011/0203671 | A1 | 8/2011 | Doig |
| 2011/0214876 | A1 | 9/2011 | Dykstra et al. |
| 2011/0240284 | A1 | 10/2011 | Hamid et al. |
| 2011/0265987 | A1 | 11/2011 | Wright |
| 2011/0266001 | A1 | 11/2011 | Dykstra |
| 2011/0297384 | A1 | 12/2011 | Fripp |
| 2011/0297385 | A1 | 12/2011 | Dykstra |
| 2011/0308806 | A9 | 12/2011 | Dykstra et al. |
| 2012/0048563 | A1 | 3/2012 | Holderman |
| 2012/0060624 | A1 | 3/2012 | Dykstra |
| 2012/0061088 | A1 | 3/2012 | Dykstra |
| 2012/0111577 | A1 | 5/2012 | Dykstra |
| 2012/0125120 | A1 | 5/2012 | Dykstra |
| 2012/0125626 | A1 | 5/2012 | Constantine |
| 2012/0138304 | A1 | 6/2012 | Dykstra |
| 2012/0145385 | A1 | 6/2012 | Lopez |
| 2012/0152527 | A1 | 6/2012 | Dykstra |
| 2012/0181037 | A1 | 7/2012 | Holderman |
| 2012/0211243 | A1 | 8/2012 | Dykstra |
| 2012/0234557 | A1 | 9/2012 | Dykstra |
| 2012/0255351 | A1 | 10/2012 | Dykstra |
| 2012/0255739 | A1 | 10/2012 | Fripp |
| 2012/0255740 | A1 | 10/2012 | Fripp |
| 2012/0305243 | A1 | 12/2012 | Hallundbaek et al. |
| 2013/0020088 | A1 | 1/2013 | Dyer et al. |
| 2013/0075107 | A1 | 3/2013 | Dykstra |

FOREIGN PATENT DOCUMENTS

| | | | |
|---|---|---|---|
| EP | 0834342 | B1 | 1/1999 |
| EP | 1672167 | | 6/2006 |
| EP | 1672167 | A1 | 6/2006 |
| EP | 1857633 | | 11/2007 |
| EP | 1857633 | A2 | 11/2007 |
| EP | 2383430 | A2 | 2/2011 |
| WO | WO 00/63530 | A1 | 12/2000 |
| WO | WO0214647 | A2 | 2/2002 |
| WO | WO03062597 | A1 | 7/2003 |
| WO | 2004012040 | A2 | 2/2004 |
| WO | 2004081335 | A2 | 9/2004 |
| WO | WO 2006/015277 | A1 | 2/2006 |
| WO | WO2006015277 | A1 | 2/2006 |
| WO | WO 2007/094897 | A2 | 8/2007 |
| WO | 2008024645 | A2 | 2/2008 |
| WO | WO2008024645 | A2 | 2/2008 |
| WO | PCT/US08/075668 | | 9/2008 |
| WO | 2009081088 | A2 | 2/2009 |
| WO | 2009052076 | A2 | 4/2009 |
| WO | WO2009052076 | A2 | 4/2009 |
| WO | WO2009052103 | A2 | 4/2009 |
| WO | WO2009052149 | A2 | 4/2009 |
| WO | PCT/US09/046363 | | 6/2009 |
| WO | PCT/US09/046404 | | 6/2009 |
| WO | WO2009088292 | A1 | 7/2009 |
| WO | WO2009088293 | A1 | 7/2009 |
| WO | WO2009088624 | A2 | 7/2009 |
| WO | 2011002615 | A2 | 1/2011 |
| WO | WO2011041674 | A2 | 4/2011 |

OTHER PUBLICATIONS

Wright, OTC 15323, The Development and Application of HT/HP Fiber-Optic Connectors for Use on Wells, May 2003, Ocean Design, Inc.

Fripp, "Development of a High-Temperature Rechargeable Battery for Downhole Use in the Petroleum Industry" 2008 OTC Conference, OTC 19621, May 5-8, 2008.

Tesar, Sampling by Fluidics and Microfluidics, Acta Polytechnica vol. 42 No. 2/2002, Jun. 24, 2005.

Partial European Search Report, Application No. EP 11164202, Nov. 30, 2011.

Kirshner, "Fluid Amplifiers", 1966, McGraw-Hill, New York.

Kirshner, et al., "Design Theory of Fluidic Components", 1975, Academic Press, New York.

"Fluidics" article, Microsoft Encarta Online Encyclopedia, copyright 1997-2009.

International Search Report and Written Opinion, PCT/US2012/032044, Mail Date Oct. 25, 2012, 9 pages.

Canadian Office Action, Application No. 2,737,998, Mail Date Jun. 21, 2013, 3 pages.

Flossert "Constant Flow Rate Product Brochure", Dec. 2002, 1 page.

Savkar, An Experimental Study of Switching in a Bistable Fluid Amplifier, University of Michigan, Dec. 1966.

"Apparatus and Method of Inducting Fluidic Oscillation in a Rotating Cleaning Nozzle," ip.com, dated Apr. 24, 2007, 3 pages.

Stephen L. Crow, Martin P. Coronado, Rustom K. Mody, "Means for Passive Inflow Control Upon Gas Breakthrough," SPE 102208, 2006

(56) References Cited

OTHER PUBLICATIONS

SPE Annual Technical Conference and Exhibition, San Antonio, Texas, U.S.A., Sep. 24-27, 2006, 6 pages.
Gebben, Vernon D., "Vortex Valve Performance Power Index," NASA TM X-52257, May 1967, pp. 1-14 plus 2 cover pages and Figures 1-8, National Aeronautics and Space Administration.
Haakh, Dr.-Ing. Frieder, "Vortex Chamber Diodes as Throttle Devices in Pipe Systems. Computation of Transient Flow," Journal of Hydraulic Research, 2003, vol. 41, No. 1, pp. 53-59.
Holmes, Allen B., et al., "A fluidic approach to the design of a mud pulser for bore-hole telemetry while drilling," DRCMS Code: 7-36AA-7100, HDL Project: A54735, Aug. 1979, pp. 1,2,5,6,9-27, and 29-37, Department of the Interior, U.S. Geological Survey, Washington, D.C.
Lee Precision Micro Hydraulics, Lee Restrictor Selector product brochure; Jan. 2011, 9 pages.
The Lee Company Technical Center, "Technical Hydraulic Handbook," 11th Edition, copyright 1971-2009, 7 pages Connecticut.
Weatherford product brochure entitled, "Application Answers—Combating Coning by Creating Even Flow Distribution in Horizontal Sand-Control Completions," 2005, 4 pages, Weatherford.
J.D Willingham, H.C. Tan, L.R. Norman, "Perforation Friction Pressure of Fracturing Fluid Slurries," SPE 25891, SPE Rocky Mountain Regional/Low Permeability Reservoirs Symposium, Denver, Co., U.S.A., Apr. 12-14, 1993, 14 pages.
Masahiro Takebayashi, Hiroshi Iwata, Akio Sakazume, Hiroaki Hata, "Discharge Characteristics of an Oil Feeder Pump Using Nozzle Type Fluidic Diodes for a Horizontal Compressor Depending on the Driving Speed," International Compressor Engineering Conference, Paper 597, 1988, 9 pages.
ADS for 2009-IP-026897U1C1, Jan. 16, 2012.
European Search Report for 11164202.1 on Dec. 7, 2011.
Tesar, Fluidic Valves for Variable-Configuration Gas Treatment, Chemical Engineering Research and Design, 83 (A9), pp. 1111-1121, Jun. 27, 2005.
Lee Restrictor Selector, Lee Jet Innovation Miniature, The Lee Company USA, Jan. 2011.
Tesar, Sampling by Fluidics and Microfluidics, Acta Polytechnica vol. 42, No. 2/2002, Jun. 24, 2005.
Angrist, Fluid Control Device, Scientific American Dec. 1964, pp. 80-88, Dec. 1, 1964.
Freyer, An Oil Selective Inflow Control System, SPE 78272, Oct. 2002.
European Search Report, Application No. EP 13 18 2098, Mail Date Nov. 13, 2013, 8 pages.
Chinese Office Action dated Apr. 18, 2014 for Application No. 201180008491.9.

* cited by examiner

APPARATUS FOR AUTONOMOUS DOWNHOLE FLUID SELECTION WITH PATHWAY DEPENDENT RESISTANCE SYSTEM

CROSS-REFERENCE TO RELATED APPLICATIONS

None

FIELD OF INVENTION

The invention relates generally to methods and apparatus for selective control of fluid flow from a formation in a hydrocarbon bearing subterranean formation into a production string in a wellbore. More particularly, the invention relates to methods and apparatus for controlling the flow of fluid based on some characteristic of the fluid flow by utilizing a flow direction control system and a pathway dependant resistance system for providing variable resistance to fluid flow. The system can also preferably include a fluid amplifier.

BACKGROUND OF INVENTION

During the completion of a well that traverses a hydrocarbon bearing subterranean formation, production tubing and various equipment are installed in the well to enable safe and efficient production of the fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more inflow control devices with the completion string.

Production from any given production tubing section can often have multiple fluid components, such as natural gas, oil and water, with the production fluid changing in proportional composition over time. Thereby, as the proportion of fluid components changes, the fluid flow characteristics will likewise change. For example, when the production fluid has a proportionately higher amount of natural gas, the viscosity of the fluid will be lower and density of the fluid will be lower than when the fluid has a proportionately higher amount of oil. It is often desirable to reduce or prevent the production of one constituent in favor of another. For example, in an oil-producing well, it may be desired to reduce or eliminate natural gas production and to maximize oil production. While various downhole tools have been utilized for controlling the flow of fluids based on their desirability, a need has arisen for a flow control system for controlling the inflow of fluids that is reliable in a variety of flow conditions. Further, a need has arisen for a flow control system that operates autonomously, that is, in response to changing conditions downhole and without requiring signals from the surface by the operator. Further, a need has arisen for a flow control system without moving mechanical parts which are subject to breakdown in adverse well conditions including from the erosive or clogging effects of sand in the fluid. Similar issues arise with regard to injection situations, with flow of fluids going into instead of out of the formation.

SUMMARY OF THE INVENTION

An apparatus is described for controlling flow of fluid in a production tubular positioned in a wellbore extending through a hydrocarbon-bearing subterranean formation. A flow control system is placed in fluid communication with a production tubular. The flow control system has a flow direction control system and a pathway dependent resistance system. The flow direction control system can preferably comprise a flow ratio control system having at least a first and second passageway, the production fluid flowing into the passageways with the ratio of fluid flow through the passageways related to a characteristic of the fluid flow, such as viscosity, density, flow rate or combinations of the properties. The pathway dependent resistance system preferably includes a vortex chamber with at least a first inlet and an outlet, the first inlet of the pathway dependent resistance system in fluid communication with at least one of the first or second passageways of the fluid ratio control system. In a preferred embodiment, the pathway dependent resistance system includes two inlets. The first inlet is positioned to direct fluid into the vortex chamber such that it flows primarily tangentially into the vortex chamber, and the second inlet is positioned to direct fluid such that it flows primarily radially into the vortex chamber. Desired fluids, such as oil, are selected based on their relative characteristics and are directed primarily radially into the vortex chamber. Undesired fluids, such as natural gas or water in an oil well, are directed into the vortex chamber primarily tangentially, thereby restricting fluid flow.

In a preferred embodiment, the flow control system also includes a fluid amplifier system interposed between the fluid ratio control system and the pathway dependent resistance system and in fluid communication with both. The fluid amplifier system can include a proportional amplifier, a jet-type amplifier, or a pressure-type amplifier. Preferably, a third fluid passageway, a primary passageway, is provided in the flow ratio control system. The fluid amplifier system then utilizes the flow from the first and second passageways as controls to direct the flow from the primary passageway.

The downhole tubular can include a plurality of inventive flow control systems. The interior passageway of the oilfield tubular can also have an annular passageway, with a plurality of flow control systems positioned adjacent the annular passageway such that the fluid flowing through the annular passageway is directed into the plurality of flow control systems.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. Upstream and downstream are used to indicate location or direction in relation to the surface, where upstream indicates relative position or movement towards the surface along the wellbore and downstream indicates relative position or movement further away from the surface along the wellbore.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

Figure 1:
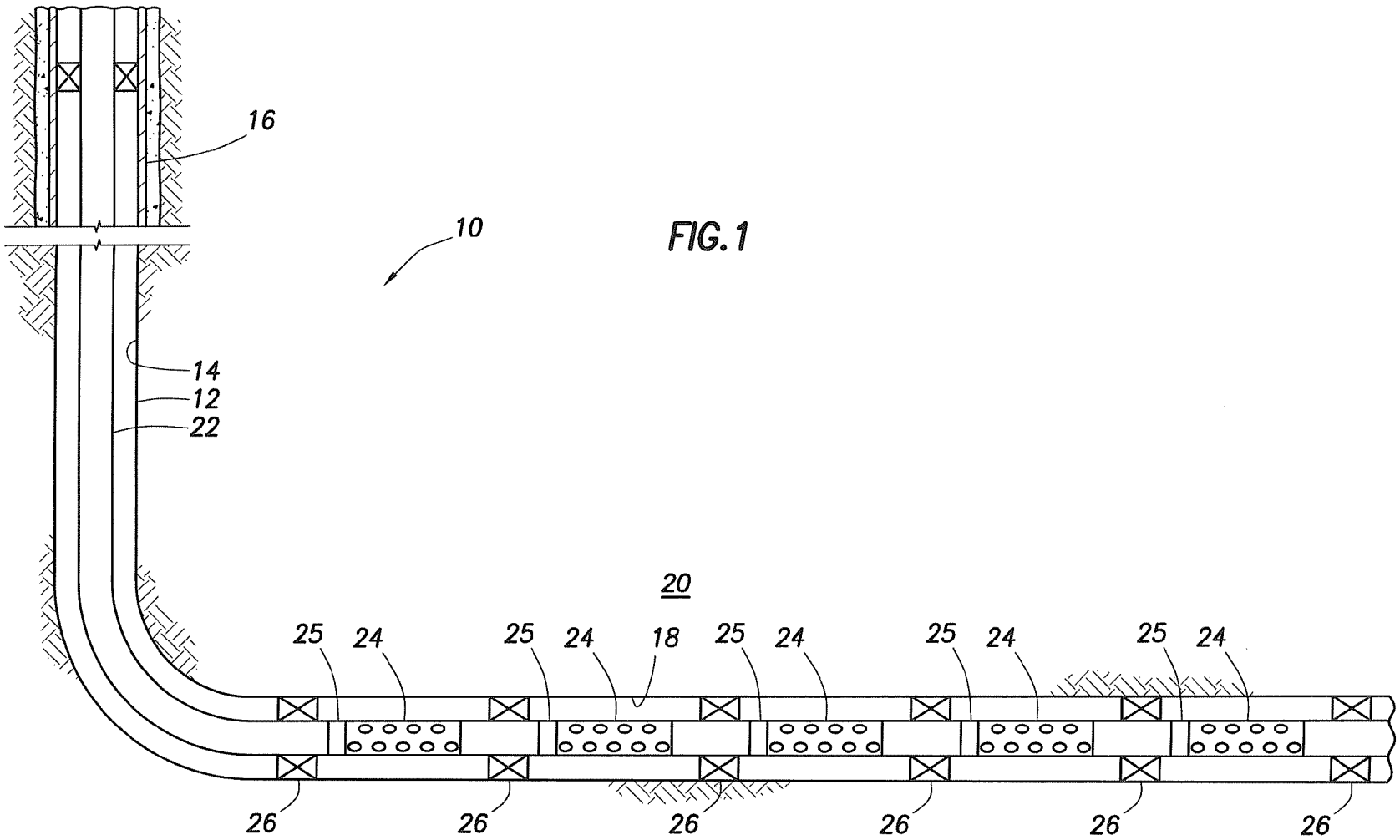
FIG. 1 is a schematic illustration of a well system including a plurality of autonomous flow control systems embodying principles of the present invention.

FIG. 1 is a schematic illustration of a well system, indicated generally 10, including a plurality of autonomous flow control systems embodying principles of the present invention. A wellbore 12 extends through various earth strata. Wellbore 12 has a substantially vertical section 14, the upper portion of which has installed therein a casing string 16. Wellbore 12 also has a substantially deviated section 18, shown as horizontal, which extends through a hydrocarbon-bearing subterranean formation 20. As illustrated, substantially horizontal section 18 of wellbore 12 is open hole. While shown here in an open hole, horizontal section of a wellbore, the invention will work in any orientation, and in open or cased hole. The invention will also work equally well with injection systems, as will be discussed supra.

Positioned within wellbore 12 and extending from the surface is a tubing string 22. Tubing string 22 provides a conduit for fluids to travel from formation 20 upstream to the surface. Positioned within tubing string 22 in the various production intervals adjacent to formation 20 are a plurality of autonomous flow control systems 25 and a plurality of production tubing sections 24. At either end of each production tubing section 24 is a packer 26 that provides a fluid seal between tubing string 22 and the wall of wellbore 12. The space in-between each pair of adjacent packers 26 defines a production interval.

In the illustrated embodiment, each of the production tubing sections 24 includes sand control capability. Sand control screen elements or filter media associated with production tubing sections 24 are designed to allow fluids to flow therethrough but prevent particulate matter of sufficient size from flowing therethrough. While the invention does not need to have a sand control screen associated with it, if one is used, then the exact design of the screen element associated with fluid flow control systems is not critical to the present invention. There are many designs for sand control screens that are well known in the industry, and will not be discussed here in detail. Also, a protective outer shroud having a plurality of perforations therethrough may be positioned around the exterior of any such filter medium.

Through use of the flow control systems 25 of the present invention in one or more production intervals, some control over the volume and composition of the produced fluids is enabled. For example, in an oil production operation if an undesired fluid component, such as water, steam, carbon dioxide, or natural gas, is entering one of the production intervals, the flow control system in that interval will autonomously restrict or resist production of fluid from that interval.

The term "natural gas" as used herein means a mixture of hydrocarbons (and varying quantities of non-hydrocarbons) that exist in a gaseous phase at room temperature and pressure. The term does not indicate that the natural gas is in a gaseous phase at the downhole location of the inventive systems. Indeed, it is to be understood that the flow control system is for use in locations where the pressure and temperature are such that natural gas will be in a mostly liquefied state, though other components may be present and some components may be in a gaseous state. The inventive concept will work with liquids or gases or when both are present.

The fluid flowing into the production tubing section 24 typically comprises more than one fluid component. Typical components are natural gas, oil, water, steam or carbon dioxide. Steam and carbon dioxide are commonly used as injection fluids to drive the hydrocarbon towards the production tubular, whereas natural gas, oil and water are typically found in situ in the formation. The proportion of these components in the fluid flowing into each production tubing section 24 will vary over time and based on conditions within the formation and wellbore. Likewise, the composition of the fluid flowing into the various production tubing sections throughout the length of the entire production string can vary significantly from section to section. The flow control system is designed to reduce or restrict production from any particular interval when it has a higher proportion of an undesired component.

Accordingly, when a production interval corresponding to a particular one of the flow control systems produces a greater proportion of an undesired fluid component, the flow control system in that interval will restrict or resist production flow from that interval. Thus, the other production intervals which are producing a greater proportion of desired fluid component, in this case oil, will contribute more to the production stream entering tubing string 22. In particular, the flow rate from formation 20 to tubing string 22 will be less where the fluid must flow through a flow control system (rather than simply flowing into the tubing string). Stated another way, the flow control system creates a flow restriction on the fluid.

Though FIG. 1 depicts one flow control system in each production interval, it should be understood that any number of systems of the present invention can be deployed within a production interval without departing from the principles of the present invention. Likewise, the inventive flow control systems do not have to be associated with every production interval. They may only be present in some of the production intervals in the wellbore or may be in the tubing passageway to address multiple production intervals.

Figure 2:
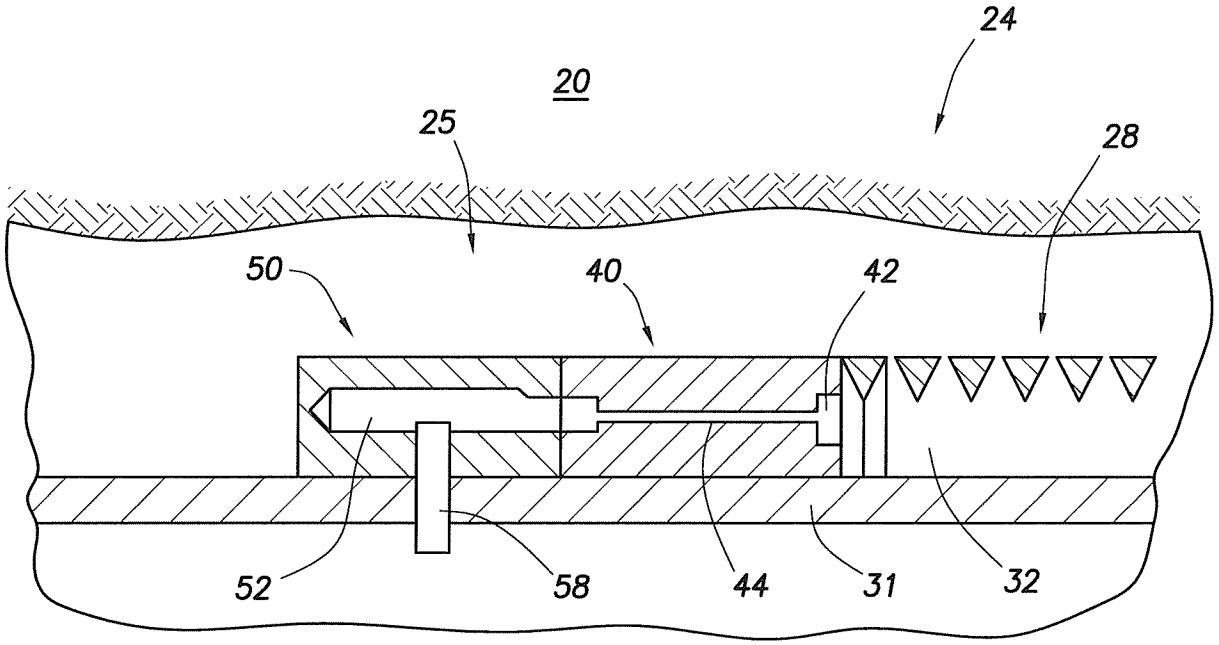
FIG. 2 is a side view in cross-section of a screen system, an inflow control system, and a flow control system according to the present invention.

FIG. 2 is a side view in cross-section of a screen system 28, and an embodiment of a flow control system 25 of the invention having a flow direction control system, including a flow ratio control system 40, and a pathway dependent resistance system 50. The production tubing section 24 has a screen system 28, an optional inflow control device (not shown) and a flow control system 25. The production tubular defines an interior passageway 32. Fluid flows from the formation 20 into the production tubing section 24 through screen system 28. The specifics of the screen system are not explained in detail here. Fluid, after being filtered by the screen system 28, if present, flows into the interior passageway 32 of the production tubing section 24. As used here, the interior passageway 32 of the production tubing section 24 can be an annular space, as shown, a central cylindrical space, or other arrangement. In practice, downhole tools will have passageways of various structures, often having fluid flow through annular passageways, central openings, coiled or tortuous paths, and other arrangements for various purposes. The fluid may be directed through a tortuous passageway or other fluid passages to provide further filtration, fluid control, pressure drops, etc. The fluid then flows into the inflow control device, if present. Various inflow control devices are well known in the art and are not described here in detail. An example of such a flow control device is commercially available from Halliburton Energy Services, Inc. under the trade mark Equi-Flow®. Fluid then flows into the inlet 42 of the flow control system 25. While suggested here that the additional inflow control device be positioned upstream from the inventive device, it could also be positioned downstream of the inventive device or in parallel with the inventive device.

Figure 3:
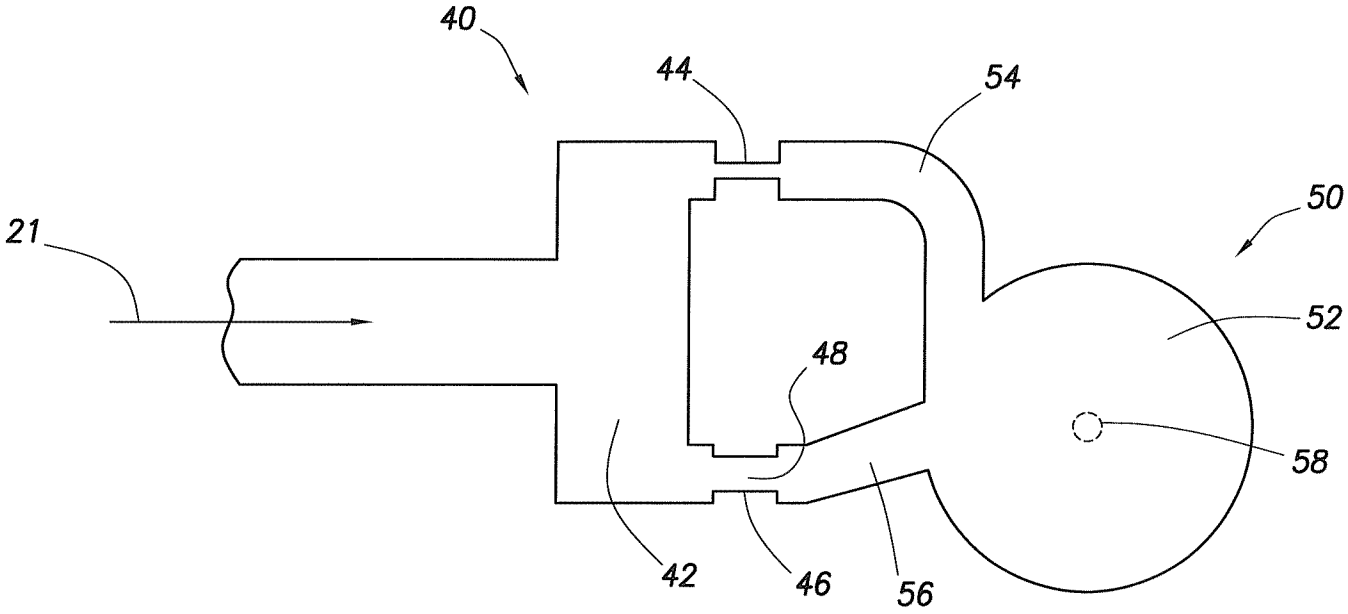
FIG. 3 is a schematic representational view of an autonomous flow control system of an embodiment of the invention.

FIG. 3 is a schematic representational view of an autonomous flow control system 25 of an embodiment of the invention. The system 25 has a fluid direction control system 40 and a pathway dependent resistance system 50.

The fluid direction control system is designed to control the direction of the fluid heading into one or more inlets of the subsequent subsystems, such as amplifiers or pathway dependent resistance systems. The fluid ratio system is a preferred embodiment of the fluid direction control system, and is designed to divide the fluid flow into multiple streams of varying volumetric ratio by taking advantage of the characteristic properties of the fluid flow. Such properties can include, but are not limited to, fluid viscosity, fluid density, flow rates or combinations of the properties. When we use the term "viscosity," we mean any of the rheological properties including kinematic viscosity, yield strength, viscoplasticity, surface tension, wettability, etc. As the proportional amounts of fluid components, for example, oil and natural gas, in the produced fluid change over time, the characteristic of the fluid flow also changes. When the fluid contains a relatively high proportion of natural gas, for example, the density and viscosity of the fluid will be less than for oil. The behavior of fluids in flow passageways is dependent on the characteristics of the fluid flow. Further, certain configurations of passageway will restrict flow, or provide greater resistance to flow, depending on the characteristics of the fluid flow. The fluid ratio control system takes advantage of the changes in fluid flow characteristics over the life of the well.

The fluid ratio system 40 receives fluid 21 from the interior passageway 32 of the production tubing section 24 or from the inflow control device through inlet 42. The ratio control system 40 has a first passageway 44 and second passageway 46. As fluid flows into the fluid ratio control system inlet 42, it is divided into two streams of flow, one in the first passageway 44 and one in the second passageway 46. The two passageways 44 and 46 are selected to be of different configuration to provide differing resistance to fluid flow based on the characteristics of the fluid flow.

The first passageway 44 is designed to provide greater resistance to desired fluids. In a preferred embodiment, the first passageway 44 is a long, relatively narrow tube which provides greater resistance to fluids such as oil and less resistance to fluids such as natural gas or water. Alternately, other designs for viscosity-dependent resistance tubes can be employed, such as a tortuous path or a passageway with a textured interior wall surface. Obviously, the resistance provided by the first passageway 44 varies infinitely with changes in the fluid characteristic. For example, the first passageway will offer greater resistance to the fluid 21 when the oil to natural gas ratio on the fluid is 80:20 than when the ratio is 60:40. Further, the first passageway will offer relatively little resistance to some fluids such as natural gas or water.

The second passageway 46 is designed to offer relatively constant resistance to a fluid, regardless of the characteristics of the fluid flow, or to provide greater resistance to undesired fluids. A preferred second passageway 46 includes at least one flow restrictor 48. The flow restrictor 48 can be a venturi, an orifice, or a nozzle. Multiple flow restrictors 48 are preferred. The number and type of restrictors and the degree of restriction can be chosen to provide a selected resistance to fluid flow. The first and second passageways may provide increased resistance to fluid flow as the fluid becomes more viscous, but the resistance to flow in the first passageway will be greater than the increase in resistance to flow in the second passageway.

Thus, the flow ratio control system 40 can be employed to divide the fluid 21 into streams of a pre-selected flow ratio. Where the fluid has multiple fluid components, the flow ratio will typically fall between the ratios for the two single components. Further, as the fluid formation changes in component constituency over time, the flow ratio will also change. The change in the flow ratio is used to alter the fluid flow pattern into the pathway dependent resistance system.

The flow control system 25 includes a pathway dependent resistance system 50. In the preferred embodiment, the pathway dependent resistance system has a first inlet 54 in fluid communication with the first passageway 44, a second inlet 56 in fluid communication with the second passageway 46, a vortex chamber 52 and an outlet 58. The first inlet 54 directs fluid into the vortex chamber primarily tangentially. The second inlet 56 directs fluid into the vortex chamber 56 primarily radially. Fluids entering the vortex chamber 52 primarily tangentially will spiral around the vortex chamber before eventually flowing through the vortex outlet 58. Fluid spiraling around the vortex chamber will suffer from frictional losses. Further, the tangential velocity produces centrifugal force that impedes radial flow. Fluid from the second inlet enters the chamber primarily radially and primarily flows down the vortex chamber wall and through the outlet without spiraling. Consequently, the pathway dependent resistance system provides greater resistance to fluids entering the chamber primarily tangentially than those entering primarily radially. This resistance is realized as back-pressure on the upstream fluid, and hence, a reduction in flow rate. Back-pressure can be applied to the fluid selectively by increasing the proportion of fluid entering the vortex primarily tangentially, and hence the flow rate reduced, as is done in the inventive concept.

The differing resistance to flow between the first and second passageways in the fluid ratio system results in a division of volumetric flow between the two passageways. A ratio can be calculated from the two volumetric flow rates. Further, the design of the passageways can be selected to result in particular volumetric flow ratios. The fluid ratio system provides a mechanism for directing fluid which is relatively less viscous into the vortex primarily tangentially, thereby producing greater resistance and a lower flow rate to the relatively less viscous fluid than would otherwise be produced.

Figure 4B:
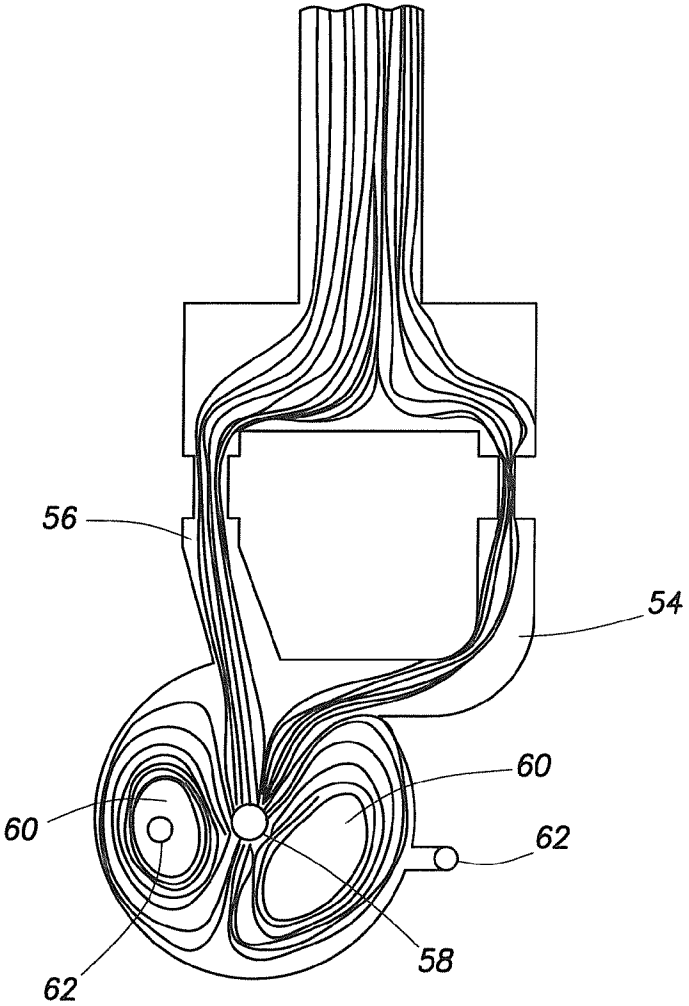
FIGS. 4A and 4B are Computational Fluid Dynamic models of the flow control system of FIG. 3 for both natural gas and oil.
Figure 4A:
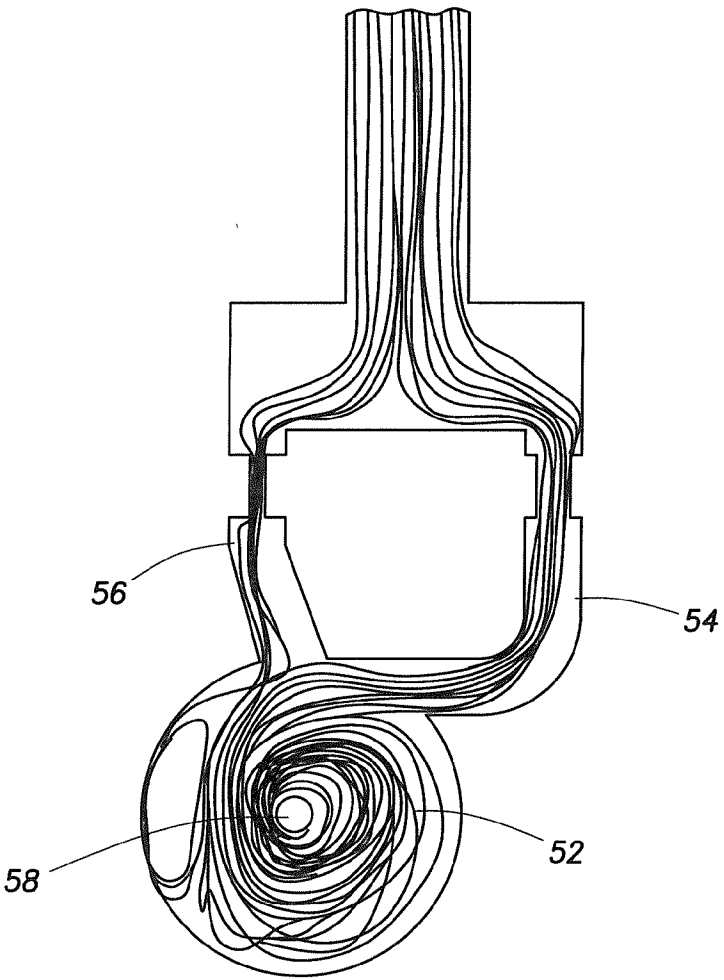

FIGS. 4A and 4B are two Computational Fluid Dynamic models of the flow control system of FIG. 3 for flow patterns of both natural gas and oil. Model 4A shows natural gas with approximately a 2:1 volumetric flow ratio (flow rate through the vortex tangential inlet 54 vs. vortex radial inlet 56) and model 4B shows oil with an approximately 1:2 flow ratio. These models show that the with proper sizing and selection of the passageways in the fluid ratio control system, the fluid composed of more natural gas can be made to shift more of its total flow to take the more energy-wasting route of entering the pathway dependent resistance system primarily tangentially. Hence, the fluid ratio system can be utilized in conjunction with the pathway dependent resistance system to reduce the amount of natural gas produced from any particular production tubing section.

Note that in FIG. 4 eddies 60 or "dead spots" can be created in the flow patterns on the walls of the vortex chamber 52. Sand or particulate matter can settle out of the fluid and build up at these eddy locations 60. Consequently, in one embodiment, the pathway dependent resistance system further includes one or more secondary outlets 62 to allow the sand to flush out of the vortex chamber 52. The secondary outlets 62 are preferably in fluid communication with the production string 22 upstream from the vortex chamber 52.

The angles at which the first and second inlets direct fluid into the vortex chamber can be altered to provide for cases when the flow entering the pathway dependent resistance system is closely balanced. The angles of the first and second inlets are chosen such that the resultant vector combination of the first inlet flow and the second inlet flow are aimed at the outlet 58 from the vortex chamber 52. Alternatively, the angles of the first and second inlet could be chosen such that the resultant vector combination of the first and second inlet flow will maximize the spiral of the fluid flow in the chamber. Alternately, the angles of the first and second inlet flow could be chosen to minimize the eddies 60 in the vortex chamber. The practitioner will recognize that the angles of the inlets at their connection with the vortex chamber can be altered to provide a desired flow pattern in the vortex chamber.

Further, the vortex chamber can include flow vanes or other directional devices, such as grooves, ridges, "waves" or other surface shaping, to direct fluid flow within the chamber or to provide additional flow resistance to certain directions of rotation. The vortex chamber can be cylindrical, as shown, or right rectangular, oval, spherical, spheroid or other shape.

Figure 5:
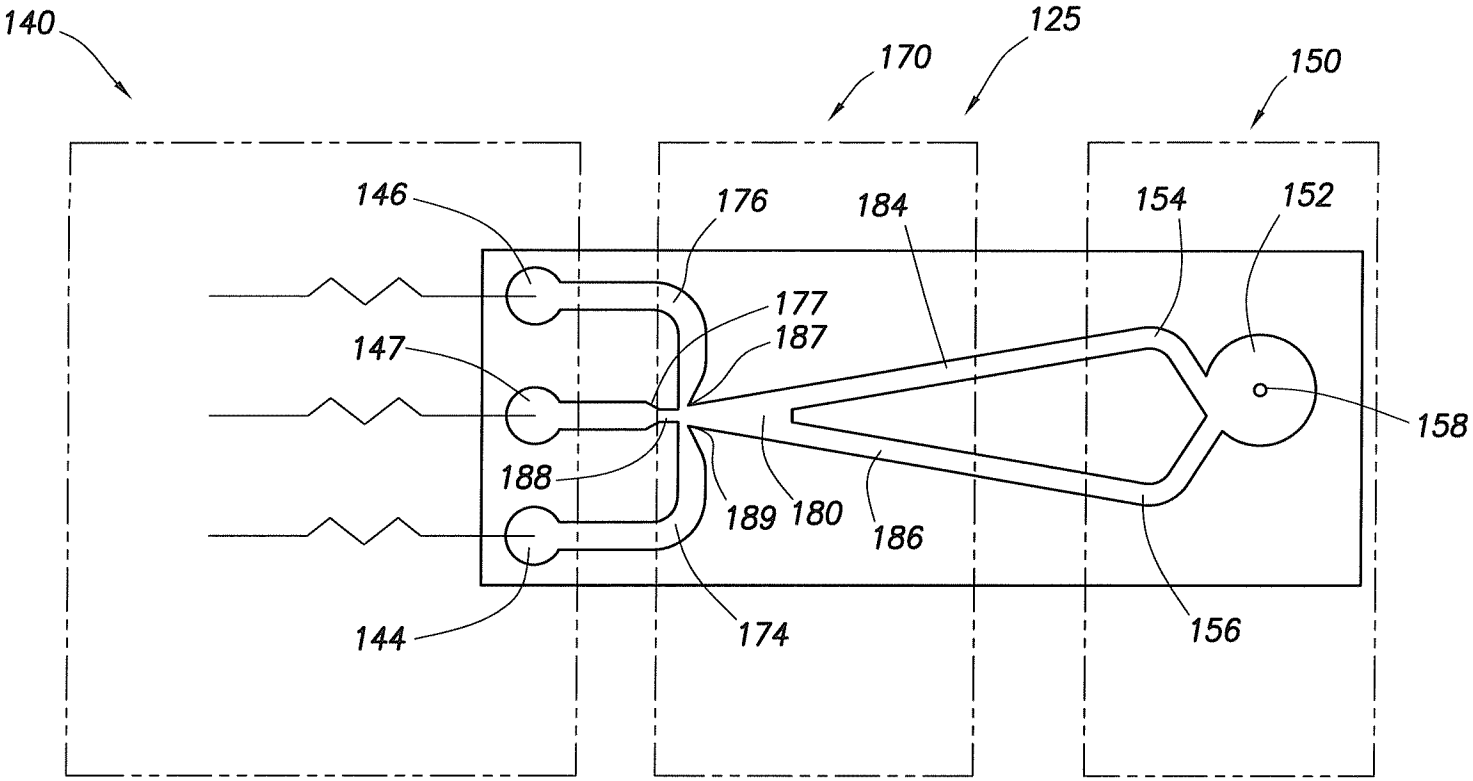
FIG. 5 is a schematic of an embodiment of a flow control system according to the present invention having a ratio control system, pathway dependent resistance system and fluid amplifier system.

FIG. 5 is a schematic of an embodiment of a flow control system 125 having a fluid ratio system 140, pathway dependent resistance system 150 and fluid amplifier system 170. In a preferred embodiment, the flow control system 125 has a fluid amplifier system 170 to amplify the ratio split produced in the first and second passageways 144, 146 of the ratio control system 140 such that a greater ratio is achieved in the volumetric flow in the first inlet 154 and second inlet 156 of the pathway dependent resistance system 150. In a preferred embodiment, the fluid ratio system 140 further includes a primary flow passageway 147. In this embodiment, the fluid flow is split into three flow paths along the flow passageways 144, 146 and 147 with the primary flow in the primary passageway 147. It is to be understood that the division of flows among the passageways can be selected by the design parameters of the passageways. The primary passageway 147 is not necessary for use of a fluid amplifier system, but is preferred. As an example of the ratio of inlet flows between the three inlets, the flow ratio for a fluid composed primarily of natural gas may be 3:2:5 for the first:second:primary passageways. The ratio for fluid primarily composed of oil may be 2:3:5.

The fluid amplifier system 170 has a first inlet 174 in fluid communication with the first passageway 144, a second inlet 176 in fluid communication with the second passageway 146 and a primary inlet 177 in fluid communication with primary passageway 147. The inlets 174, 176 and 177 of the fluid amplifier system 170 join together at amplifier chamber 180. Fluid flow into the chamber 180 is then divided into amplifier outlet 184 which is in fluid communication with pathway dependent resistance system inlet 154, and amplifier outlet 186 which is in fluid communication with pathway dependent resistance system inlet 156. The amplifier system 170 is a fluidic amplifier which uses relatively low-value input flows to control higher output flows. The fluid entering the amplifier system 170 becomes a stream forced to flow in selected ratios into the outlet paths by careful design of the internal shapes of the amplifier system 170. The input passageways 144 and 146 of the fluid ratio system act as controls, supplying jets of fluid which direct the flow from the primary passageway 147 into a selected amplifier outlet 184 or 186. The control jet flow can be of far lower power than the flow of the primary passageway stream, although this is not necessary. The amplifier control inlets 174 and 176 are positioned to affect the resulting flow stream, thereby controlling the output through outlets 184 and 186.

The internal shape of the amplifier inlets can be selected to provide a desired effectiveness in determining the flow pattern through the outlets. For example, the amplifier inlets 174 and 176 are illustrated as connecting at right angles to the primary inlet 177. Angles of connection can be selected as desired to control the fluid stream. Further, the amplifier inlets 174, 176 and 177 are each shown as having nozzle restrictions 187, 188 and 189, respectively. These restrictions provide a greater jetting effect as the flow through the inlets merges at chamber 180. The chamber 180 can also have various designs, including selecting the sizes of the inlets, the angles at which the inlets and outlets attach to the chamber, the shape of the chamber, such as to minimize eddies and flow separation, and the size and angles of the outlets. Persons of skill in the art will recognize that FIG. 5 is but one example embodiment of a fluid amplifier system and that other arrangements can be employed. Further, the number and type of fluid amplifier can be selected.

Figure 6B:
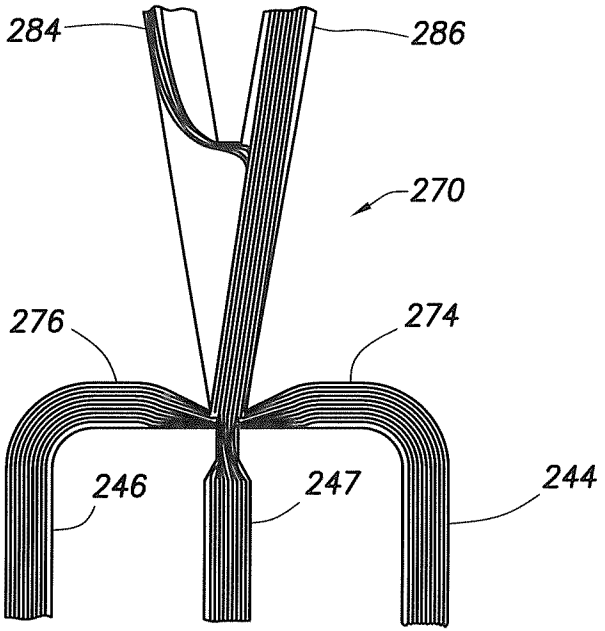
FIGS. 6A and 6B are Computational Fluid Dynamic models showing the flow ratio amplification effects of a fluid amplifier system in a flow control system in an embodiment of the invention.
Figure 6A:
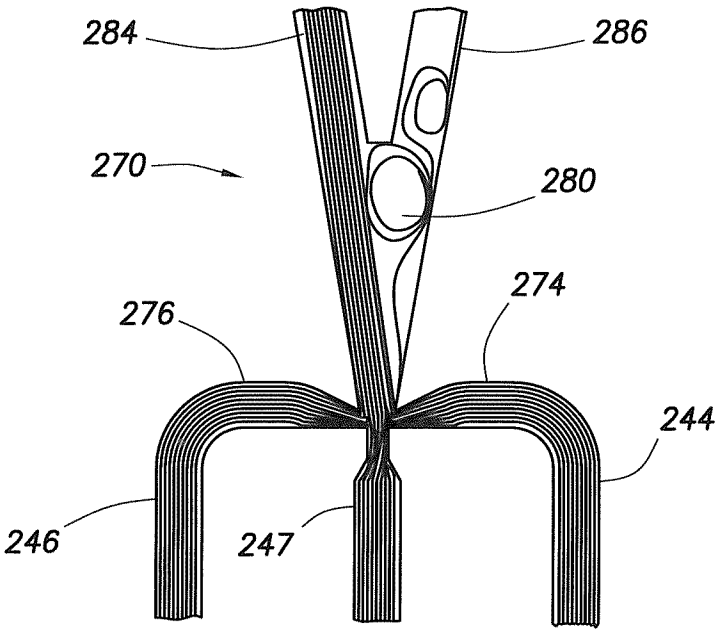

FIGS. 6A and 6B are two Computational Fluid Dynamic models showing the flow ratio amplification effects of a fluid amplifier system 270 in a flow control system in an embodiment of the invention. Model 6A shows the flow paths when the only fluid component is natural gas. The volumetric flow ratio between the first passageway 244 and second passageway 246 is 30:20, with fifty percent of the total flow in the primary passageway 247. The fluid amplifier system 270 acts to amplify this ratio to 98:2 between the first amplifier outlet 284 and second outlet 286. Similarly, model 6B shows an amplification of flow ratio from 20:30 (with fifty percent of the total flow through the primary passageway) to 19:81 where the sole fluid component is oil.

Figure 7:
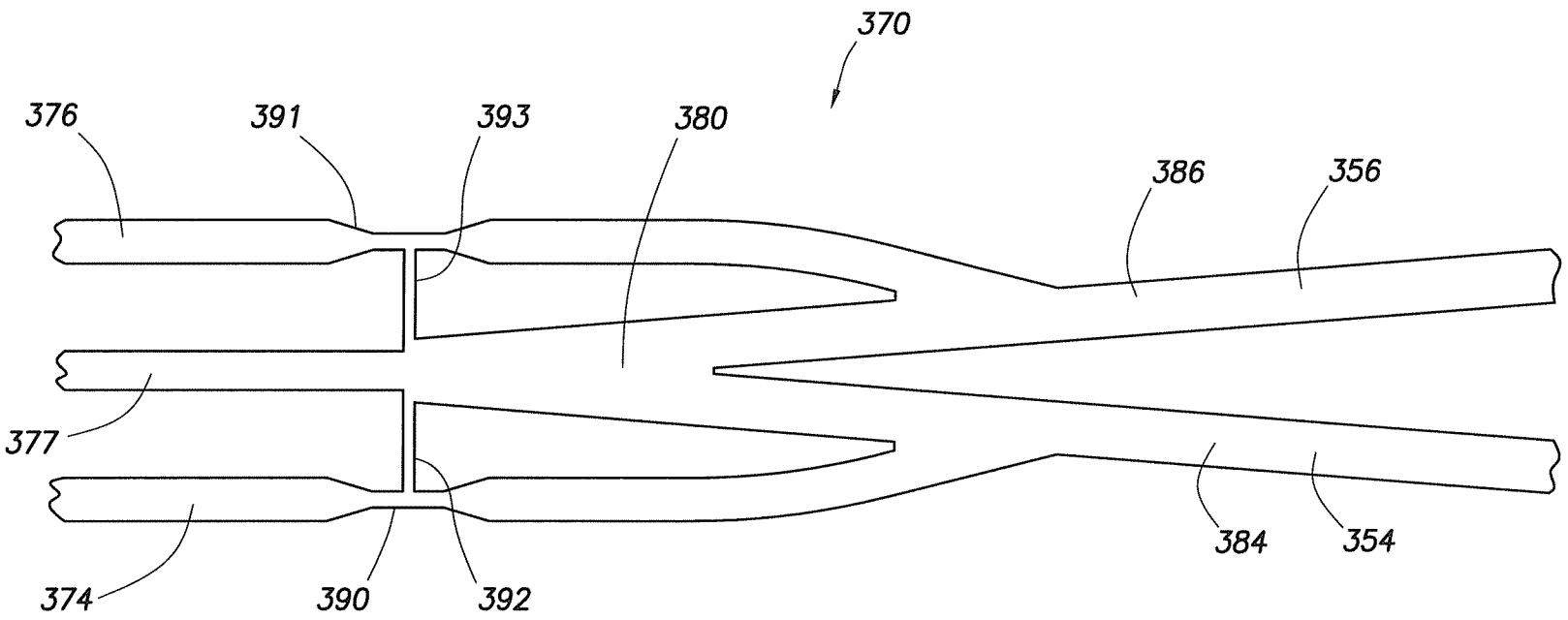
FIG. 7 is schematic of a pressure-type fluid amplifier system for use in the present invention.

The fluid amplifier system 170 illustrated in FIG. 5 is a jet-type amplifier; that is, the amplifier uses the jet effect of the incoming streams from the inlets to alter and direct the path of flow through the outlets. Other types of amplifier systems, such as a pressure-type fluid amplifier, are shown in FIG. 7. The pressure-type amplifier system 370 of FIG. 7 is a fluidic amplifier which uses relatively low-value input pressures to control higher output pressures; that is, fluid pressure acts as the control mechanism for directing the fluid stream. The first amplifier inlet 374 and second inlet 376 each have a venturi nozzle restriction 390 and 391, respectively, which acts to increase fluid speed and thereby to reduce fluid pressure in the inlet passageway. Fluid pressure communication ports 392 and 393 convey the pressure difference between the first and second inlets 374 and 376 to the primary inlet 377. The fluid flow in the primary inlet 377 will be biased toward the low pressure side and away from the high pressure side. For example, where the fluid has a relatively larger proportion of natural gas component, the fluid volumetric flow ratio will be weighted towards the first passageway of the fluid ratio system and first inlet 374 of the amplifier system 370. The greater flow rate in the first inlet 374 will result in a lower pressure transmitted through pressure port 390, while the lesser flow rate in the second inlet 376 will result in a higher pressure communicated through port 393. The higher pressure will "push," or the lower pressure will "suction," the primary fluid flow through the primary inlet 377 resulting in a greater proportion of flow through amplifier outlet 354. Note that the outlets 354 and 356 in this embodiment are in different positions than the outlets in the jet-type amplifier system of FIG. 5.

Figure 8:
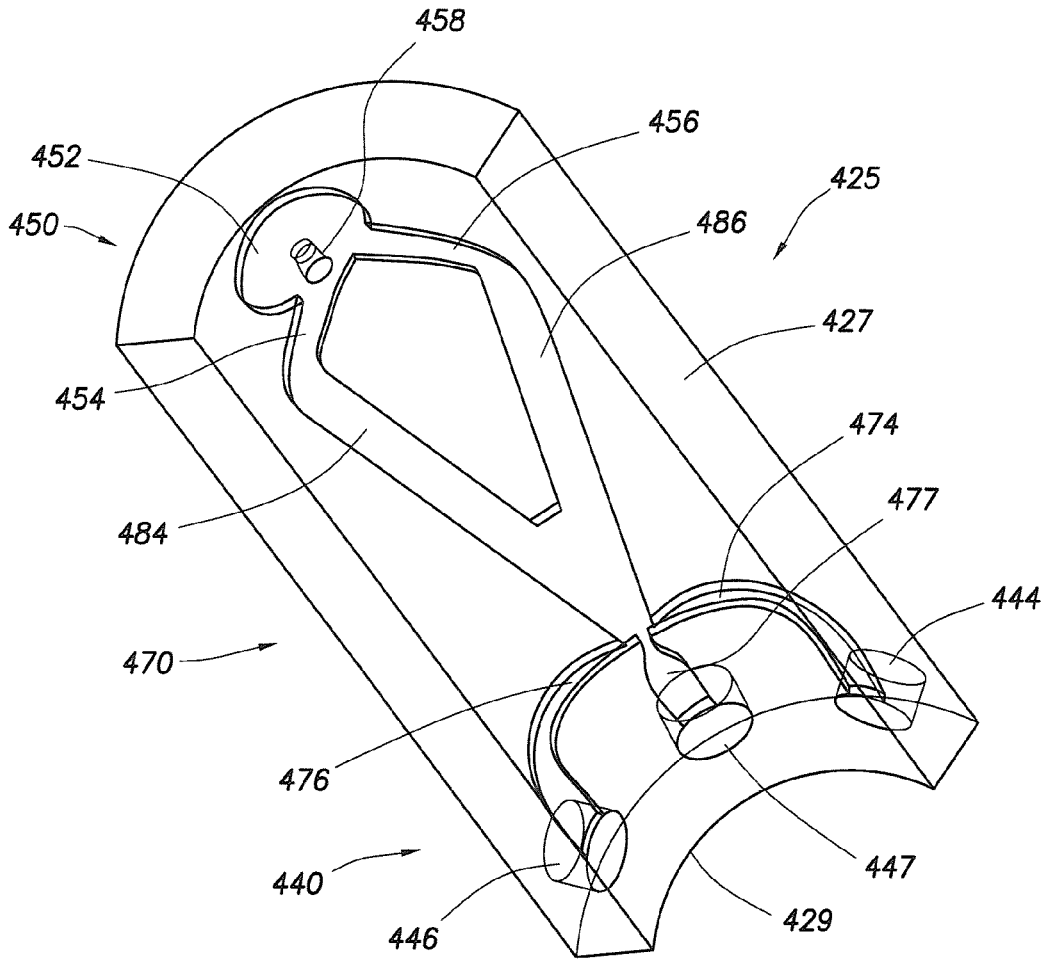
FIG. 8 is a perspective view of a flow control system according to the present invention positioned in a tubular wall.

FIG. 8 is a perspective view (with "hidden" lines displayed) of a flow control system of a preferred embodiment in a production tubular. The flow control system 425, in a preferred embodiment, is milled, cast, or otherwise formed "into" the wall of a tubular. The passageways 444, 446, 447, inlets 474, 476, 477, 454, 456, chambers such as vortex chamber 452, and outlets 484, 486 of the ratio control system 440, fluid amplifier system 470 and pathway dependent resistance system 450 are, at least in part, defined by the shape of exterior surface 429 of the tubular wall 427. A sleeve is then place over the exterior surface 429 of the wall 427 and portions of the interior surface of the sleeve 433 define, at least in part, the various passageways and chambers of the system 425. Alternately, the milling may be on the interior surface of the sleeve with the sleeve positioned to cover the exterior surface of the tubular wall. In practice, it may be preferred that the tubular wall and sleeve define only selected elements of the flow control system. For example, the pathway dependent resistance system and amplifier system may be defined by the tubular wall while the ratio control system passageways are not. In a preferred embodiment, the first passageway of the fluid ratio control system, because of its relative length, is wrapped or coiled around the tubular. The wrapped passageway can be positioned within, on the exterior or interior of the tubular wall. Since the length of the second passageway of the ratio control system is typically not required to be of the same length as the first passageway, the second passageway may not require wrapping, coiling, etc.

Figure 9:
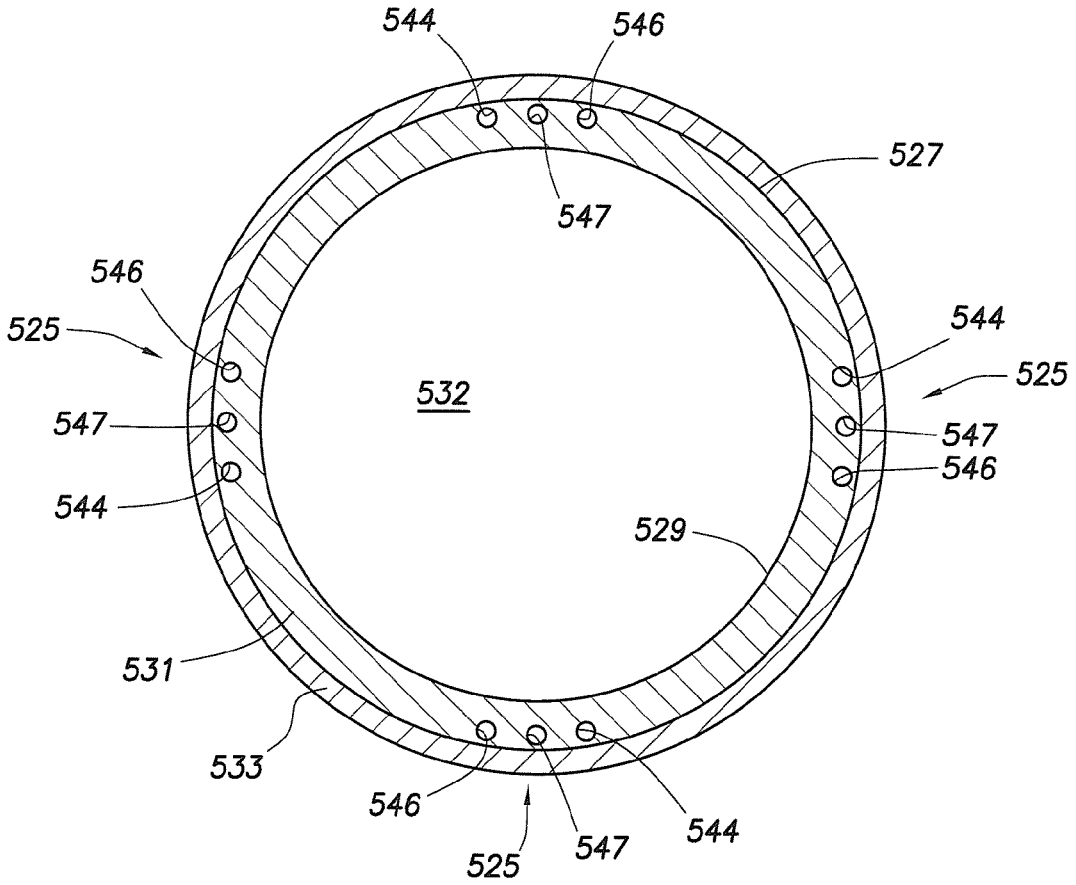
FIG. 9 is an end view in cross-section of a plurality of flow control systems of the present invention positioned in a tubular wall.

Multiple flow control systems 525 can be used in a single tubular. For example, FIG. 9 shows multiple flow control systems 525 arranged in the tubular wall 531 of a single tubular. Each flow control system 525 receives fluid input from an interior passageway 532 of the production tubing section. The production tubular section may have one or multiple interior passageways for supplying fluid to the flow control systems. In one embodiment, the production tubular has an annular space for fluid flow, which can be a single annular passageway or divided into multiple passageways spaced about the annulus. Alternately, the tubular can have a single central interior passageway from which fluid flows into one or more flow control systems. Other arrangements will be apparent to those skilled in the art.

Figure 10:
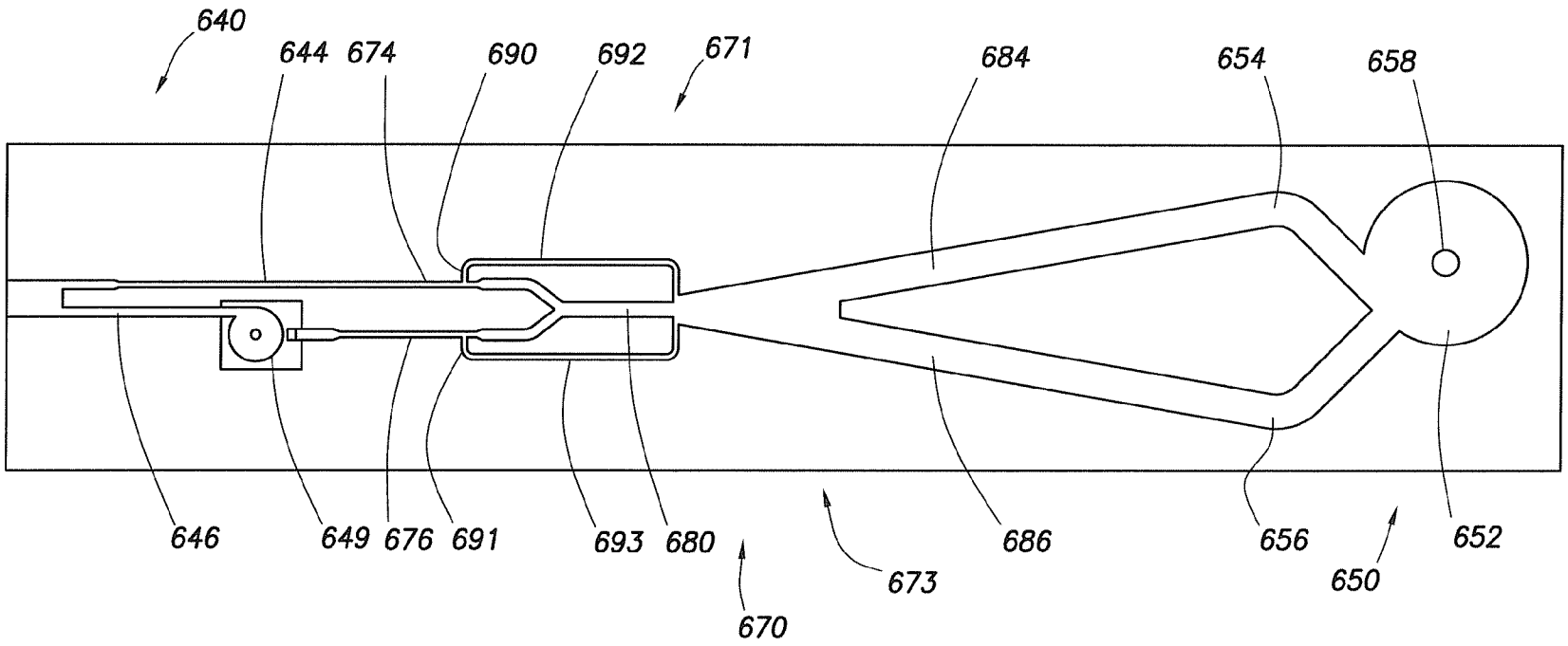
FIG. 10 is a schematic of an embodiment of a flow control system according to the present invention having a flow ratio control system, a pressure-type fluid amplifier system, a bistable switch amplifier system and a pathway dependent resistance system.

FIG. 10 is a schematic of a flow control system having a fluid ratio system 640, a fluid amplifier system 670 which utilizes a pressure-type amplifier with a bistable switch, and a pathway dependent resistance system 650. The flow control system as seen in FIG. 10 is designed to select oil flow over gas flow. That is, the system creates a greater back-pressure when the formation fluid is less viscous, such as when it is comprised of a relatively higher amount of gas, by directing most of the formation fluid into the vortex primarily tangentially. When the formation fluid is more viscous, such as when it comprises a relatively larger amount of oil, then most of the fluid is directed into the vortex primarily radially and little back-pressure is created. The pathway dependent resistance system 650 is downstream from the amplifier 670 which, in turn, is downstream from the fluid ratio control system 640. As used with respect to various embodiments of the fluid selector device herein, "downstream" shall mean in the direction of fluid flow while in use or further along in the direction of such flow. Similarly, "upstream" shall mean the opposite direction. Note that these terms may be used to describe relative position in a wellbore, meaning further or closer to the surface; such use should be obvious from context.

The fluid ratio system 640 is again shown with a first passageway 644 and a second passageway 646. The first passageway 644 is a viscosity-dependent passageway and will provide greater resistance to a fluid of higher Viscosity. The first passageway can be a relatively long, narrow tubular passageway as shown, a tortuous passageway or other design providing requisite resistance to viscous fluids. For example, a laminar pathway can be used as a viscosity-dependent fluid flow pathway. A laminar pathway forces fluid flow across a relatively large surface area in a relatively thin layer, causing a decrease in velocity to make the fluid flow laminar. Alternately, a series of differing sized pathways can function as a viscosity-dependent pathway. Further, a swellable material can be used to define a pathway, wherein the material swells in the presence of a specific fluid, thereby shrinking the fluid pathway. Further, a material with different surface energy, such as a hydrophobic, hydrophilic, water-wet, or oil-wet material, can be used to define a pathway, wherein the wettability of the material restricts flow.

The second passageway 646 is less viscosity dependent, that is, fluids behave relatively similarly flowing through the second passageway regardless of their relative viscosities. The second passageway 646 is shown having a vortex diode 649 through which the fluid flows. The vortex diode 649 can be used as an alternative for the nozzle passageway 646 as explained herein, such as with respect to FIG. 3, for example. Further, a swellable material or a material with special wettability can be used to define a pathway.

Fluid flows from the ratio control system 640 into the fluid amplifier system 670. The first passageway 644 of the fluid ratio system is in fluid communication with the first inlet 674 of the amplifier system. Fluid in the second passageway 646 of the fluid ratio system flows into the second inlet 676 of the amplifier system. Fluid flow in the first and second inlets combines or merges into a single flow path in primary passageway 680. The amplifier system 670 includes a pressure-type fluid amplifier 671 similar to the embodiment described above with regard to FIG. 7. The differing flow rates of the fluids in the first and second inlet create differing pressures. Pressure drops are created in the first and second inlets at the junctions with the pressure communication ports. For example, and as explained above, venturi nozzles 690 and 691, can be utilized at or near the junctions. Pressure communication ports 692 and 693 communicate the fluid pressure from the inlets 674 and 676, respectively, to the jet of fluid in primary passageway 680. The low pressure communication port, that is, the port connected to the inlet with the higher flow rate, will create a low-pressure "suction" which will direct the fluid as it jets through the primary passageway 680 past the downstream ends of the pressure communication ports.

In the embodiment seen at FIG. 10, the fluid flow through inlets 674 and 676 merges into a single flow-path prior to being acted upon by the pressure communication ports. The alternative arrangement in FIG. 7 shows the pressure ports directing flow of the primary inlet 377, with the flow in the primary inlet split into two flow streams in first and second outlets 384 and 386. The flow through the first inlet 374 merges with flow through second outlet 386 downstream of the pressure communication ports 392 and 393. Similarly, flow in second inlet 376 merges with flow in first outlet 384 downstream from the communication ports. In FIG. 10, all of the fluid flow through the fluid amplifier system 670 is merged together in a single jet at primary passageway 680 prior to, or upstream of, the communication ports 692 and 693. Thus the pressure ports act on the combined stream of fluid flow.

The amplifier system 670 also includes, in this embodiment, a bistable switch 673, and first and second outlets 684 and 686. Fluid moving through primary passageway 680 is split into two fluid streams in first and second outlets 684 and 686. The flow of the fluid from the primary passageway is directed into the outlets by the effect of the pressure communicated by the pressure communication ports, with a resulting fluid flow split into the outlets. The fluid split between the outlets 684 and 686 defines a fluid ratio; the same ratio is defined by the fluid volumetric flow rates through the pathway dependent resistance system inlets 654 and 656 in this embodiment. This fluid ratio is an amplified ratio over the ratio between flow through inlets 674 and 676.

The flow control system in FIG. 10 includes a pathway dependent resistance system 650. The pathway dependent resistance system has a first inlet 654 in fluid communication with the first outlet 684 of the fluid amplifier system 644, a second inlet 656 in fluid communication with the second passageway 646, a vortex chamber 52 and an outlet 658. The first inlet 654 directs fluid into the vortex chamber primarily tangentially. The second inlet 656 directs fluid into the vortex chamber 656 primarily radially. Fluid entering the vortex chamber 652 primarily tangentially will spiral around the vortex wall before eventually flowing through the vortex outlet 658. Fluid spiraling around the vortex chamber increases in speed with a coincident increase in frictional losses. The tangential velocity produces centrifugal force that impedes radial flow. Fluid from the second inlet enters the chamber primarily radially and primarily flows down the vortex chamber wall and through the outlet without spiraling. Consequently, the pathway dependent resistance system provides greater resistance to fluids entering the chamber primarily tangentially than those entering primarily radially. This resistance is realized as back-pressure on the upstream fluid. Back-pressure can be applied to the fluid selectively where the proportion of fluid entering the vortex primarily tangentially is controlled.

The pathway dependent resistance system 650 functions to provide resistance to the fluid flow and a resulting back-pressure on the fluid upstream. The resistance provided to the fluid flow is dependent upon and in response to the fluid flow pattern imparted to the fluid by the fluid ratio system and, consequently, responsive to changes in fluid viscosity. The fluid ratio system selectively directs the fluid flow into the pathway dependent resistance system based on the relative viscosity of the fluid over time. The pattern of fluid flow into the pathway dependent resistance system determines, at least in part, the resistance imparted to the fluid flow by the pathway dependent resistance system. Elsewhere herein is described pathway dependent resistance system use based on the relative flow rate over time. The pathway dependent resistance system can possibly be of other design, but a system providing resistance to the fluid flow through centripetal force is preferred.

Note that in this embodiment, the fluid amplifier system outlets 684 and 686 are on opposite "sides" of the system when compared to the outlets in FIG. 5. That is, in FIG. 10 the first passageway of the fluid ratio system, the first inlet of the amplifier system and the first inlet of the pathway dependent resistance system are all on the same longitudinal side of the flow control system. This is due to the use of a pressure-type amplifier 671; where a jet-type amplifier is utilized, as in FIG. 5, the first fluid ratio control system passageway and first vortex inlet will be on opposite sides of the system. The relative positioning of passageways and inlets will depend on the type and number of amplifiers employed. The critical design element is that the amplified fluid flow be directed into the appropriate vortex inlet to provide radial or tangential flow in the vortex.

The embodiment of the flow control system shown in FIG. 11 can also be modified to utilize a primary passageway in the fluid ratio system, and primary inlet in the amplifier system, as explained with respect to FIG. 5 above.

Figure 11A:
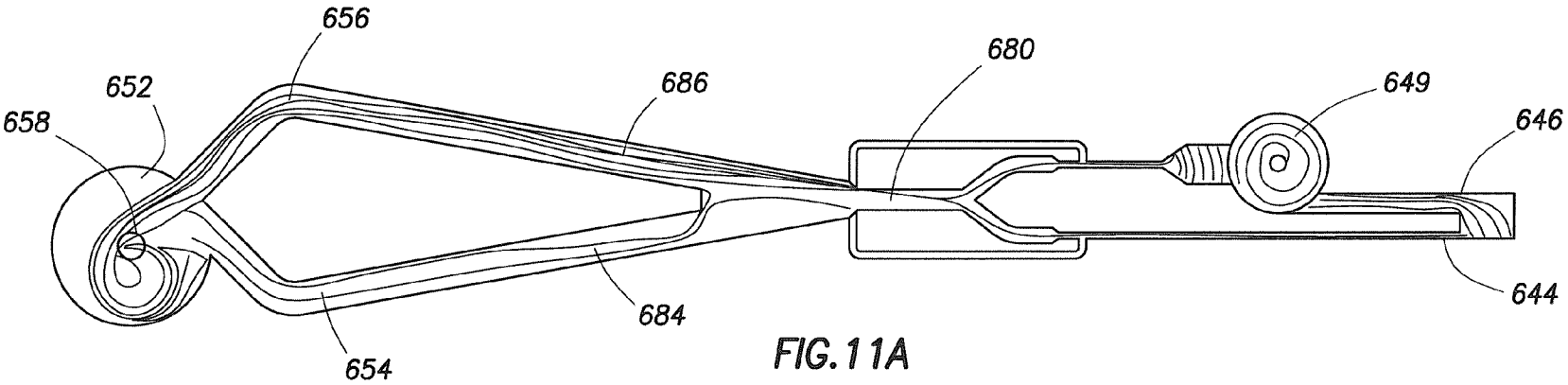
FIGS. 11A-B are Computational Fluid Dynamic models showing the flow ratio amplification effects of the embodiment of a flow control system as illustrated in FIG. 10.
Figure 11B:
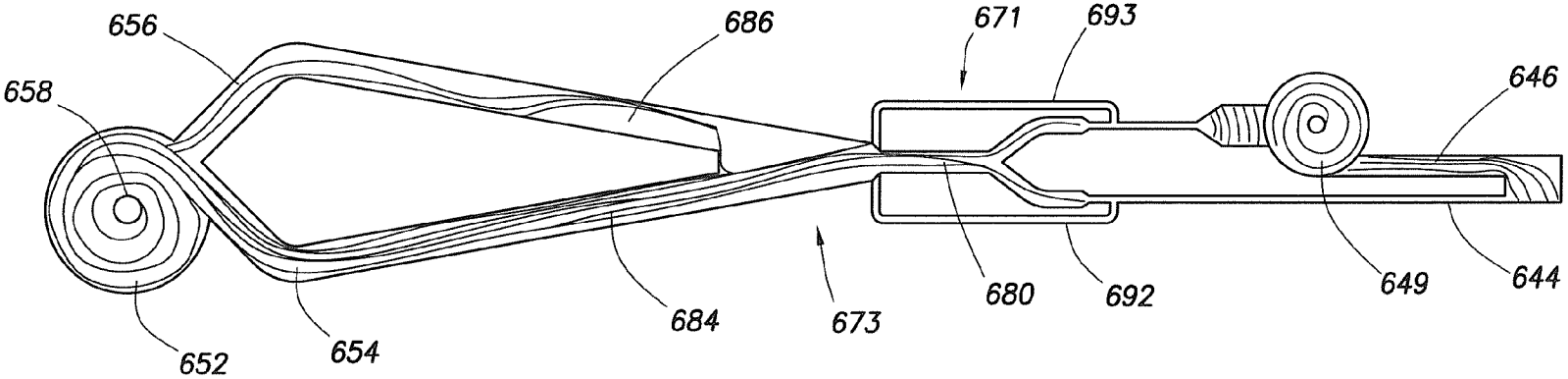

FIGS. 11A-B are Computational Fluid Dynamic models showing test results of flowing fluid of differing viscosities through the flow system as seen in FIG. 10. The tested system utilized a viscosity-dependent first passageway 644 having an ID with a cross-section of 0.04 square inches. The viscosity-independent passageway 646 utilized a 1.4 inch diameter vortex diode 649. A pressure-type fluid amplifier 671 was employed, as shown and as explained above. The bistable switch 673 used was 13 inches long with 0.6 inch passageways. The pathway dependent resistance system 650 had a 3 inch diameter chamber with a 0.5 inch outlet port.

FIG. 11A shows a Computational Fluid Dynamic model of the system in which oil having a viscosity of 25 cP is tested. The fluid flow ratio defined by volumetric fluid flow rate through the first and second passageways of the flow ratio control system was measured as 47:53. In the pressure-type amplifier 671 the flow rates were measured as 88.4% through primary passageway 680 and 6.6% and 5% through the first and second pressure ports 692 and 693, respectively. The fluid ratio induced by the fluid amplifier system, as defined by the flow rates through the first and second amplifier outlets 684 and 686, was measured as 70:30. The bistable switch or the selector system, with this flow regime, is said to be "open."

FIG. 118 shows a Computational Fluid Dynamic model of the same system utilizing natural gas having a viscosity of 0.022 cP. The Computational Fluid Dynamic model is for gas under approximately 5000 psi. The fluid flow ratio defined by volumetric fluid flow rate through the first and second passageways of the flow ratio control system was measured as 55:45. In the pressure-type amplifier 671 the flow rates were measured as 92.6% through primary passageway 680 and 2.8% and 4.6% through the first and second pressure ports 692 and 693, respectively. The fluid ratio induced by the fluid amplifier system, as defined by the flow rates through the first and second amplifier outlets 684 and 686, was measured as 10:90. The bistable switch or the selector system, with this flow regime, is said to be "closed" since the majority of fluid is directed through the first vortex inlet 654 and enters the vortex chamber 652 primarily tangentially, as can be seen by the flow patterns in the vortex chamber, creating relatively high back-pressure on the fluid.

In practice, it may be desirable to utilize multiple fluid amplifiers in series in the fluid amplifier system. The use of multiple amplifiers will allow greater differentiation between fluids of relatively similar viscosity; that is, the system will better be able to create a different flow pattern through the system when the fluid changes relatively little in overall viscosity. A plurality of amplifiers in series will provide a greater amplification of the fluid ratio created by the fluid ratio control device. Additionally, the use of multiple amplifiers will help overcome the inherent stability of any bistable switch in the system, allowing a change in the switch condition based on a smaller percent change of fluid ratio in the fluid ratio control system.

Figure 12:
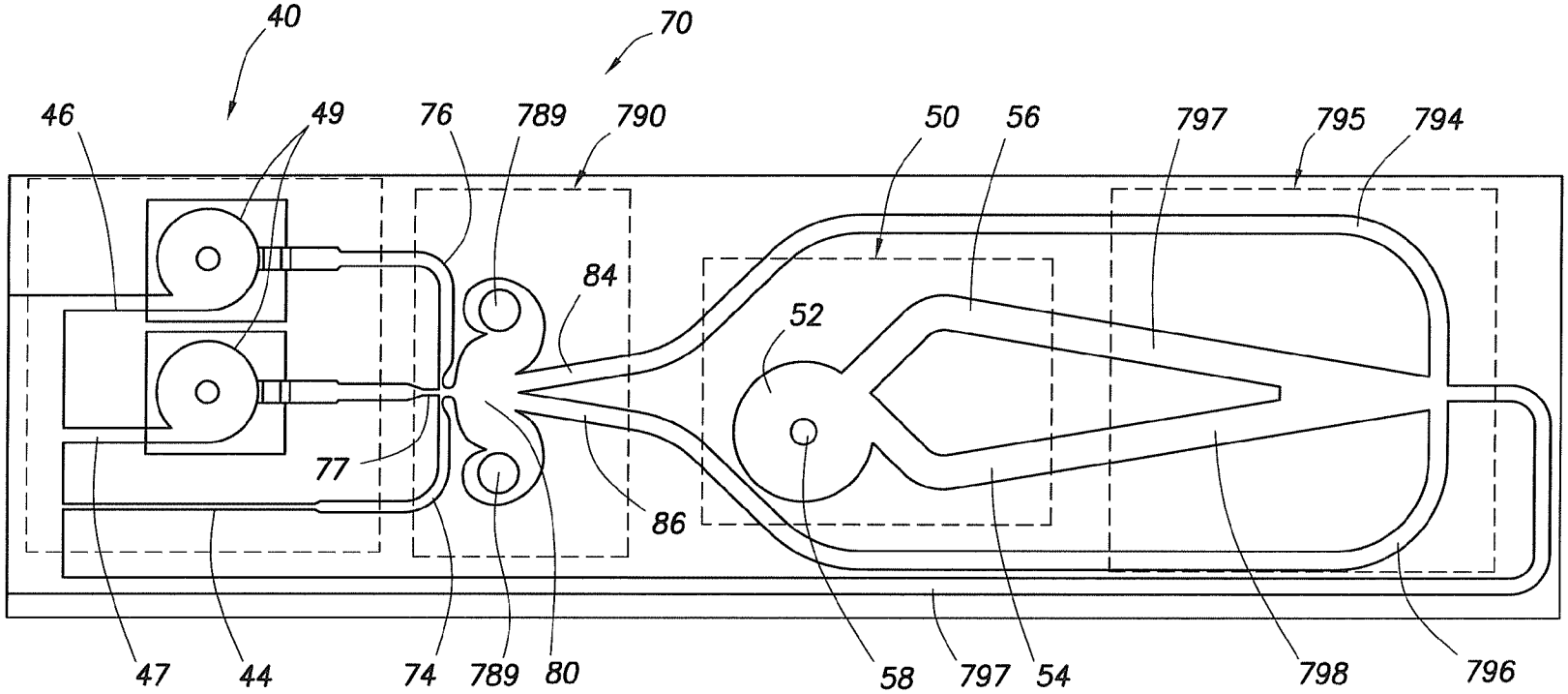
FIG. 12 is a schematic of a flow control system according to one embodiment of the invention utilizing a fluid ratio control system, a fluid amplifier system having a proportional amplifier in series with a bistable type amplifier, and a pathway dependent resistance system.

FIG. 12 is a schematic of a flow control system according to one embodiment of the invention utilizing a fluid ratio control system 740, a fluid amplifier system 770 having two amplifiers 790 and 795 in series, and a pathway dependent resistance system 750. The embodiment in FIG. 12 is similar to the flow control systems described herein and will be addressed only briefly. From upstream to downstream, the system is arranged with the flow ratio control system 740, the fluid amplifier system 770, the bi-stable amplifier system 795, and the pathway dependent resistance system 750.

The fluid ratio system 740 is shown having first, second and primary passageways 744, 746, and 747. In this case, both the second 46 and primary passageways 747 utilize vortex diodes 749. The use of vortex diodes and other control devices is selected based on design considerations including the expected relative viscosities of the fluid over time, the preselected or target viscosity at which the fluid selector is to "select" or allow fluid flow relatively unimpeded through the system, the characteristics of the environment in which the system is to be used, and design considerations such as space, cost, ease of system, etc. Here, the vortex diode 749 in the primary passageway 747 has a larger outlet than that of the vortex diode in the second passageway 746. The vortex diode is included in the primary passageway 747 to create a more desirable ratio split, especially when the formation fluid is comprised of a larger percentage of natural gas. For example based on testing, with or without a vortex diode 749 in the primary passageway 747, a typical ratio split (first:second: primary) through the passageways when the fluid is composed primarily of oil was about 29:38:33. When the test fluid was primarily composed of natural gas and no vortex diode was utilized in the primary passageway, the ratio split was 35:32:33. Adding the vortex diode to the primary passageway, that ratio was altered to 38:33:29. Preferably, the ratio control system creates a relatively larger ratio between the viscosity-dependent and independent passageways (or vice versa depending on whether the user wants to select production for higher or lower viscosity fluid). Use of the vortex diode assists in creating a larger ratio. While the difference in using the vortex diode may be relatively small, it enhances the performance and effectiveness of the amplifier system.

Note that in this embodiment a vortex diode 749 is utilized in the "viscosity independent" passageway 746 rather than a multiple orifice passageway. As explained herein, different embodiments may be employed to create passageways which are relatively dependent or independent dependent on viscosity. Use of a vortex diode 749 creates a lower pressure drop for a fluid such as oil, which is desirable in some utilizations of the device. Further, use of selected viscosity-dependent fluid control devices (vortex diode, orifices, etc.) may improve the fluid ratio between passageways depending on the application.

The fluid amplifier system 770 in the embodiment shown in FIG. 12 includes two fluid amplifiers 790 and 795. The amplifiers are arranged in series. The first amplifier is a proportional amplifier 790. The first amplifier system 790 has a first inlet 774, second inlet 776, and primary inlet 777 in fluid communication with, respectively, the first passageway 746, second passageway 746 and primary passageway 747 of the fluid ratio control system. The first, second and primary inlets are connected to one another and merge the fluid flow through the inlets as described elsewhere herein. The fluid flow is joined into a single fluid flow stream at proportional amplifier chamber 780. The flow rates of fluid from the first and second inlets direct the combined fluid flow into the first outlet 784 and second outlet 786 of the proportional amplifier 790. The proportional amplifier system 790 has two "lobes" for handling eddy flow and minor flow disruption. A pressure-balancing port 789 fluidly connects the two lobes for balancing pressure between the two lobes on either side of the amplifier.

The fluid amplifier system further includes a second fluid amplifier system 795, in this case a bistable switch amplifier. The amplifier 795 has a first inlet 794, a second inlet 796 and a primary inlet 797. The first and second inlets 794 and 796 are, respectively, in fluid communication with first and second outlets 784 and 786. The bistable switch amplifier 795 is shown having a primary inlet 797 which is in fluid communication with the interior passageway of the tubular. The fluid flow from the first and second inlets 794 and 796 direct the combined fluid flows from the inlets into the first and second outlets 798 and 799. The pathway dependent resistance system 750 is as described elsewhere herein.

Multiple amplifiers can be employed in series to enhance the ratio division of the fluid flow rates. In the embodiment shown, for example, where a fluid composed primarily of oil is flowing through the selector system, the fluid ratio system 740 creates a flow ratio between the first and second passageways of 29:38 (with the remaining 33 percent of flow through the primary passageway). The proportional amplifier system 790 may amplify the ratio to approximately 20:80 (first: second outlets of amplifier system 790). The bistable switch amplifier system 795 may then amplify the ratio further to, say, 10:90 as the fluid enters the first and second inlets to the pathway dependent resistance system. In practice, a bistable amplifier tends to be fairly stable. That is, switching the flow pattern in the outlets of the bistable switch may require a relatively large change in flow pattern in the inlets. The proportional amplifier tends to divide the flow ratio more evenly based on the inlet flows. Use of a proportional amplifier, such as at 790, will assist in creating a large enough change in flow pattern into the bistable switch to effect a change in the switch condition (from "open" to "closed and vice versa).

The use of multiple amplifiers in a single amplifier system can include the use of any type or design of amplifier known in the art, including pressure-type, jet-type, bistable, proportional amplifiers, etc., in any combination. It is specifically taught that the amplifier system can utilize any number and type of fluid amplifier, in series or parallel. Additionally, the amplifier systems can include the use of primary inlets or not, as desired. Further, as shown, the primary inlets can be fed with fluid directly from the interior passageway of the tubular or other fluid source. The system in FIG. 12 is shown "doubling-back" on itself; that is, reversing the direction of flow from left to right across the system to right to left. This is a space-saving technique but is not critical to the invention. The specifics of the relative spatial positions of the fluid ratio system, amplifier system and pathway dependent resistance system will be informed by design considerations such as available space, sizing, materials, system and manufacturing concerns.

Figure 13A:
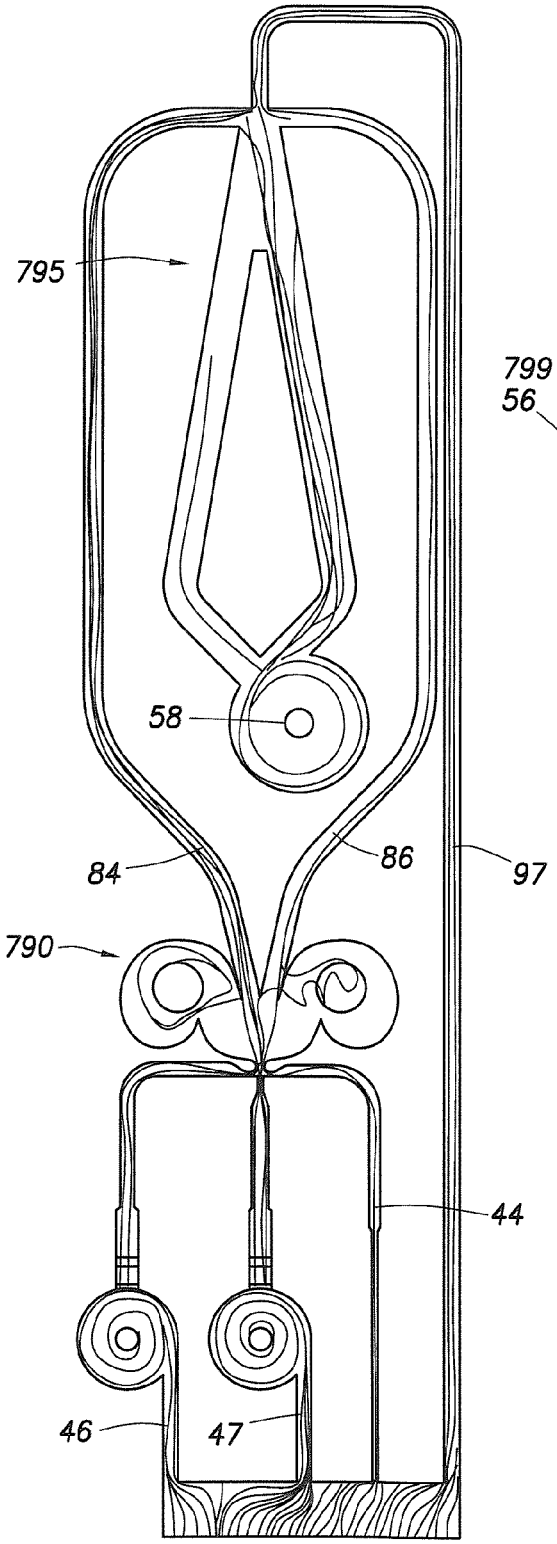
FIGS. 13A and 13B are Computational Fluid Dynamic models showing the flow patterns of fluid in the embodiment of the flow control system as seen in FIG. 12.
Figure 13B:
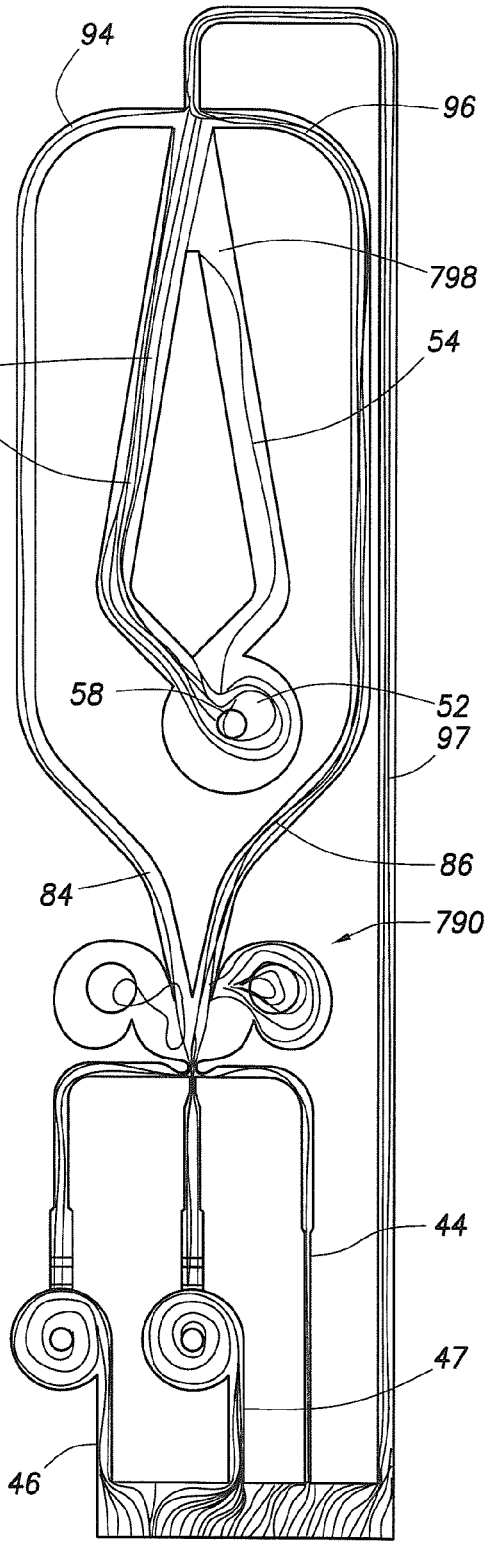

FIGS. 13A and 13B are Computational Fluid Dynamic models showing the flow patterns of fluid in the embodiment of the flow control system as seen in FIG. 12. In FIG. 13A, the fluid utilized was natural gas. The fluid ratio at the first, second and primary fluid ratio system outlets was 38:33:29. The proportional amplifier system 790 amplified the ratio to approximately 60:40 in the first and second outlets 784 and 786. That ratio was further amplified by the second amplifier system 795, where the first:second:primary inlet ratio was approximately 40:30:20. The output ratio of the second amplifier 795 as measured at either the first and second outlets 798 and 799 or at the first and second inlets to the pathway dependent resistance system was approximately 99:1. The fluid of relatively low viscosity was forced to flow primarily into the first inlet of the pathway dependent resistance system and then into the vortex at a substantially tangential path. The fluid is forced to substantially rotate about the vortex creating a greater pressure drop than if the fluid had entered the vortex primarily radially. This pressure drop creates a back-pressure on the fluid in the selector system and slows production of fluid.

In FIG. 13B, a Computational Fluid Dynamic model is shown wherein the tested fluid was composed of oil of viscosity 25 cP. The fluid ratio control system 740 divided the flow rate into a ratio of 29:38:33. The first amplifier system 790 amplified the ratio to approximately 40:60. The second amplifier system 795 further amplified that ratio to approximately 10:90. As can be seen, the fluid was forced to flow into the pathway dependent resistance system primarily through the second substantially radial inlet 56. Although some rotational flow is created in the vortex, the substantial portion of flow is radial. This flow pattern creates less of a pressure drop on the oil than would be created if the oil flowed primarily tangentially into the vortex. Consequently, less back-pressure is created on the fluid in the system. The flow control system is said to "select" the higher viscosity fluid, oil in this case, over the less viscous fluid, gas.

Figure 14:
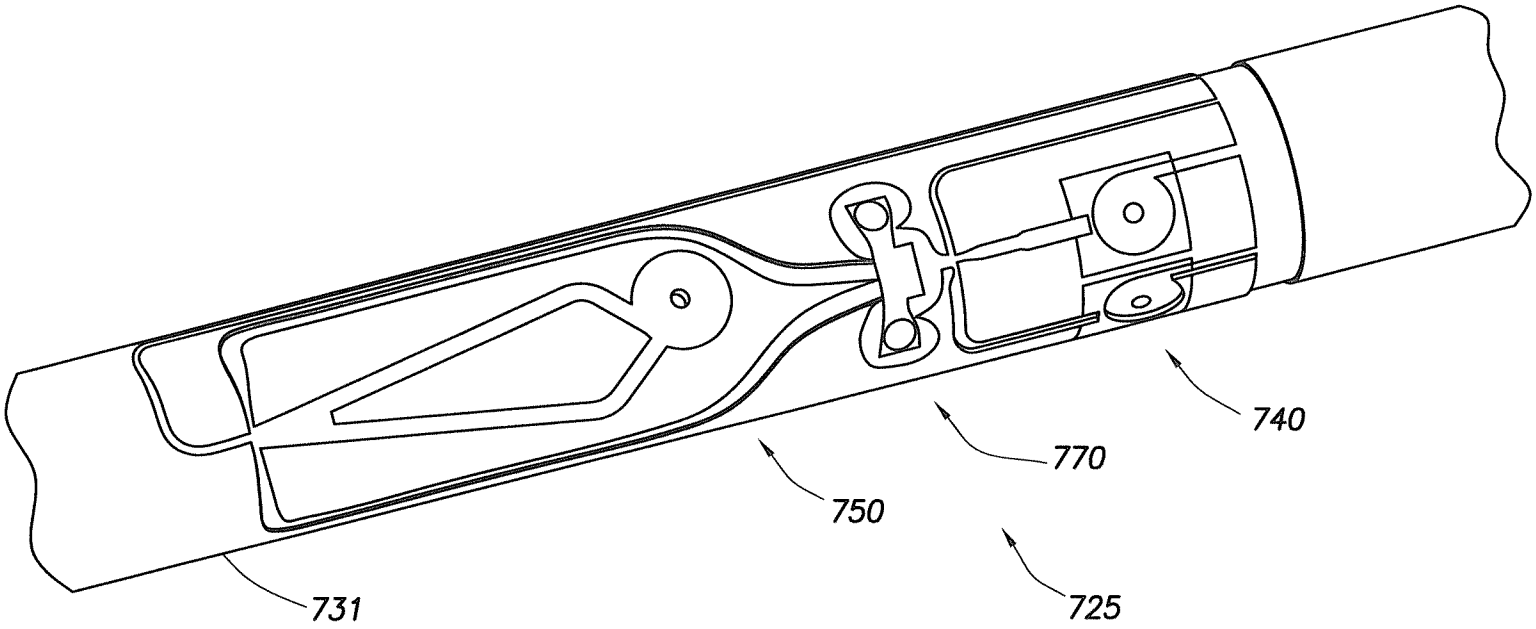
FIG. 14 is a perspective view of a flow control system according to the present invention positioned in a tubular wall.

FIG. 14 is a perspective, cross-sectional view of a flow control system according to the present invention as seen in FIG. 12 positioned in a tubular wall. The various portions of the flow control system 25 are created in the tubular wall 731. A sleeve, not shown, or other covering is then placed over the system. The sleeve, in this example, forms a portion of the walls of the various fluid passageways. The passageways and vortices can be created by milling, casting or other method. Additionally, the various portions of the flow control system can be manufactured separately and connected together.

The examples and testing results described above in relation to FIGS. 10-14 are designed to select a more viscous fluid, such as oil, over a fluid with different characteristics, such as natural gas. That is, the flow control system allows relatively easier production of the fluid when it is composed of a greater proportion of oil and provides greater restriction to production of the fluid when it changes in composition over time to having a higher proportion of natural gas. Note that the relative proportion of oil is not necessarily required to be greater than half to be the selected fluid. It is to be expressly understood that the systems described can be utilized to select between any fluids of differing characteristics. Further, the system can be designed to select between the formation fluid as it varies between proportional amounts of any fluids. For example, in an oil well where the fluid flowing from the formation is expected to vary over time between ten and twenty percent oil composition, the system can be designed to select the fluid and allow relatively greater flow when the fluid is composed of twenty percent oil.

In a preferred embodiment, the system can be used to select the fluid when it has a relatively lower viscosity over when it is of a relatively higher viscosity. That is, the system can select to produce gas over oil, or gas over water. Such an arrangement is useful to restrict production of oil or water in a gas production well. Such a design change can be achieved by altering the pathway dependent resistance system such that the lower viscosity fluid is directed into the vortex primarily radially while the higher viscosity fluid is directed into the pathway dependent resistance system primarily tangentially. Such a system is shown at FIG. 15.

Figure 15:
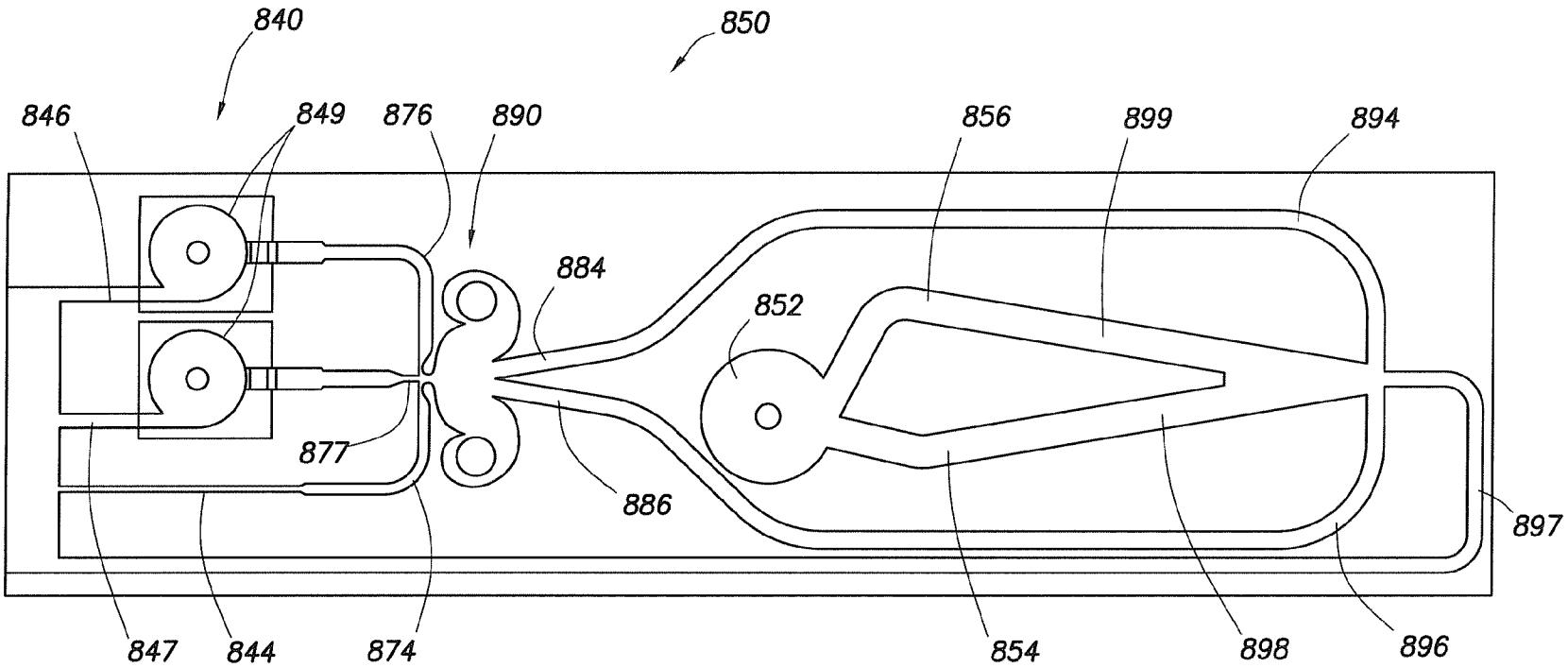
FIG. 15 is a schematic of a flow control system according to one embodiment of the invention designed to select a lower viscosity fluid over a higher viscosity fluid.

FIG. 15 is a schematic of a flow control system according to one embodiment of the invention designed to select a lower viscosity fluid over a higher viscosity fluid. FIG. 15 is substantially similar to FIG. 12 and will not be explained in detail. Note that the inlets 854 and 856 to the vortex chamber 852 are modified, or "reversed," such that the inlet 854 directs fluid into the vortex 852 primarily radially while the inlet 856 directs fluid into the vortex chamber primarily tangentially. Thus, when the fluid is of relatively low viscosity, such as when composed primarily of natural gas, the fluid is directed into the vortex primarily radially. The fluid is "selected," the flow control system is "open," a low resistance and back-pressure is imparted on the fluid, and the fluid flows relatively easily through the system. Conversely, when the fluid is of relatively higher viscosity, such as when composed of a higher percentage of water, it is directed into the vortex primarily tangentially. The higher viscosity fluid is not selected, the system is "closed," a higher resistance and back-pressure (than would be imparted without the system in place) is imparted to the fluid, and the production of the fluid is reduced. The flow control system can be designed to switch between open and, closed at a preselected viscosity or percentage composition of fluid components. For example, the system may be designed to close when the fluid reaches 40% water (or a viscosity equal to that of a fluid of that composition). The system can be used in production, such as in gas wells to prevent water or oil production, or in injection systems for selecting injection of steam over water. Other uses will be evident to those skilled in the art, including using other characteristics of the fluid, such as density or flow rate.

The flow control system can be used in other methods, as well. For example, in oilfield work-over and production it is often desired to inject a fluid, typically steam, into an injection well.

Figure 16:
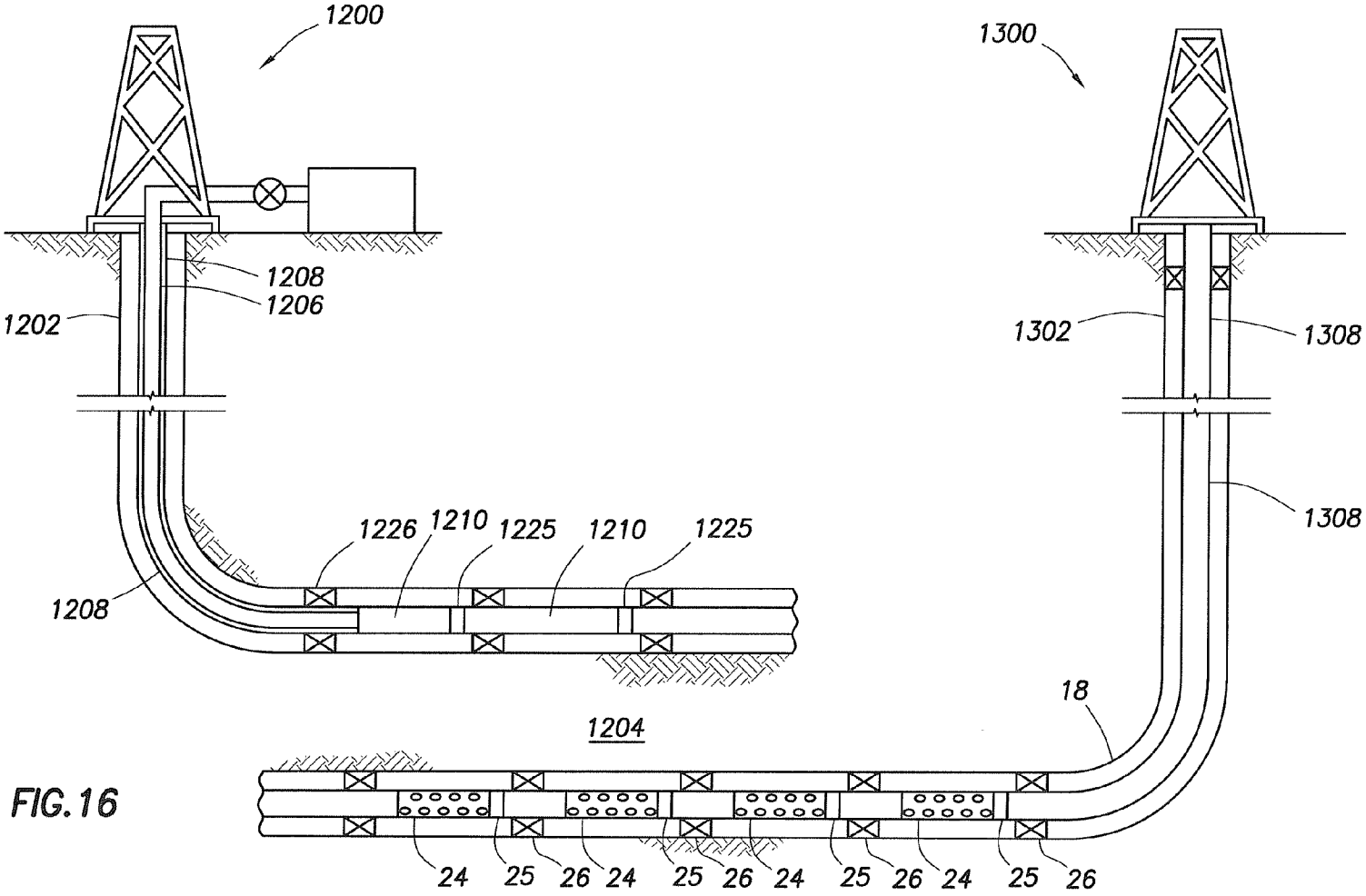
FIG. 16 is a schematic showing use of flow control systems of the invention in an injection and a production well.

FIG. 16 is a schematic showing use of the flow control system of the invention in an injection and a production well. One or more injection wells 1200 are injected with an injection fluid while desired formation fluids are produced at one or more production well 1300. The production well 1300 wellbore 1302 extends through the formation 1204. A tubing production string 1308 extends through the wellbore having a plurality of production tubular sections 24. The production tubular sections 24 can be isolated from one another as described in relation to FIG. 1 by packers 26. Flow control systems can be employed on either or both of the injection and production wells.

Injection well 1200 includes a wellbore 1202 extending through a hydrocarbon bearing formation 1204. The injection apparatus includes one or more steam supply lines 1206 which typically extend from the surface to the downhole location of injection on a tubing string 1208. Injection methods are known in the art and will not be described here in detail. Multiple injection port systems 1210 are spaced along the length of the tubing string 1208 along the target zones of the formation. Each of the port systems 1210 includes one or more autonomous flow control systems 1225. The flow control systems can be of any particular arrangement discussed herein, for example, of the design shown at FIG. 15, shown in a preferred embodiment for injection use. During the injection process, hot water and steam are often commingled and exist in varying ratios in the injection fluid. Often hot water is circulated downhole until the system has reached the desired temperature and pressure conditions to provide primarily steam for injection into the formation. It is typically not desirable to inject hot water into the formation.

Consequently, the flow control systems 1225 are utilized to select for injection of steam (or other injection fluid) over injection of hot water or other less desirable fluids. The fluid ratio system will divide the injection fluid into flow ratios based on a relative characteristic of the fluid flow, such as viscosity, as it changes over time. When the injection fluid has an undesirable proportion of water and a consequently relatively higher viscosity, the ratio control system will divide the flow accordingly and the selector system will direct the fluid into the tangential inlet of the vortex thereby restricting injection of water into the formation. As the injection fluid changes to a higher proportion of steam, with a consequent change to a lower viscosity, the selector system directs the fluid into the pathway dependent resistance system primarily radially allowing injection of the steam with less back-pressure than if the fluid entered the pathway dependent resistance system primarily tangentially. The fluid ratio control system 40 can divide the injection fluid based on any characteristic of the fluid flow, including viscosity, density, and velocity.

Additionally, flow control systems 25 can be utilized on the production well 1300. The use of the selector systems 25 in the production well can be understood through the explanation herein, especially with reference to FIGS. 1 and 2. As steam is forced through the formation 1204 from the injection well 1200, the resident hydrocarbon, for example oil, in the formation is forced to flow towards and into the production well 1300. Flow control systems 25 on the production well 1300 will select for the desired production fluid and restrict the production of injection fluid. When the injection fluid "breaks through" and begins to be produced in the production well, the flow control systems will restrict production of the injection fluid. It is typical that the injection fluid will break-through along sections of the production wellbore unevenly. Since the flow control systems are positioned along isolated production tubing sections, the flow control systems will allow for less restricted production of formation fluid in the production tubing sections where break-through has not occurred and restrict production of injection fluid from sections where break-through has occurred. Note that the fluid flow from each production tubing section is connected to the production string 302 in parallel to provide for such selection.

The injection methods described above are described for steam injection. It is to be understood that carbon dioxide or other injection fluid can be utilized. The selector system will operate to restrict the flow of the undesired injection fluid, such as water, while not providing increased resistance to flow of desired injection fluid, such as steam or carbon dioxide. In its most basic design, the flow control system for use in injection methods is reversed in operation from the fluid flow control as explained herein for use in production. That is, the injection fluid flows from the supply lines, through the flow control system (flow ratio control system, amplifier system and pathway dependent resistance system), and then into the formation. The flow control system is designed to select the preferred injection fluid; that is, to direct the injection fluid into the pathway dependent resistance system primarily radially. The undesired fluid, such as water, is not selected; that is, it is directed into the pathway dependent resistance system primarily tangentially. Thus, when the undesired fluid is present in the system, a greater back-pressure is created on the fluid and fluid flow is restricted. Note that a higher back-pressure is imparted on the fluid entering primarily tangentially than would be imparted were the selector system not utilized. This does not require that the back-pressure necessarily be higher on a non-selected fluid than on a selected fluid, although that may well be preferred.

A bistable switch, such as shown at switch 170 in FIG. 5 and at switch 795 in FIG. 12, has properties which can be utilized for flow control even without the use of a flow ratio system. Bistable switch 795 performance is flow rate, or velocity, dependent. That is, at low velocities or flow rates the switch 795 lacks bistability and fluid flows into the outlets 798 and 799 in approximately equal amounts. As the rate of flow into the bistable switch 795 increases, bistability eventually forms.

At least one bistable switch can be utilized to provide selective fluid production in response to fluid velocity or flow rate variation. In such a system, fluid is "selected" or the fluid control system is open where the fluid flow rate is under a preselected rate. The fluid at a low rate will flow through the system with relatively little resistance. When the flow rate increases above the preselected rate, the switch is "flipped" closed and fluid flow is resisted. The closed valve will, of course, reduce the flow rate through the system. A bistable switch 170, as seen in FIG. 5, once activated, will provide a Coanda effect on the fluid stream. The Coanda effect is the tendency of a fluid jet to be attracted to a nearby surface. The term is used to describe the tendency of the fluid jet exiting the flow ratio system, once directed into a selected switch outlet, such as outlet 184, to stay directed in that flow path even where the flow ratio returns to its previous condition due to the proximity of the fluid switch wall. At a low flow rate, the bistable switch lacks bistability and the fluid flows approximately equally through the outlets 184 and 186 and then about equally into the vortex inlets 154 and 156. Consequently, little back-pressure is created on the fluid and the flow control system is effectively open. As the rate of flow into the bistable switch 170 increases, bistability eventually forms and the switch performs as intended, directing a majority of the fluid flow through outlet 84 and then primarily tangentially into the vortex 152 through inlet 154 thereby closing the valve. The back-pressure, of course, will result in reduced flow rate, but the Coanda effect will maintain the fluid flow into switch outlet 184 even as the flow rate drops. Eventually, the flow rate may drop enough to overcome the Coanda effect and flow will return to approximately equal flow through the switch outlets, thereby re-opening the valve.

The velocity or flow rate dependent flow control system can utilize fluid amplifiers as described above in relation to fluid viscosity dependent selector systems, such as seen in FIG. 12.

In another embodiment of a velocity or flow rate dependent autonomous flow control system, a system utilizing a fluid ratio system, similar to that shown at ratio control system 140 in FIG. 5, is used. The ratio control system passageways 144 and 146 are modified, as necessary, to divide the fluid flow based on relative fluid flow rate (rather than relative viscosity). A primary passageway 147 can be used if desired. The ratio control system in this embodiment divides the flow into a ratio based on fluid velocity. Where the velocity ratio is above a preselected amount (say, 1.0), the flow control system is closed and resists flow. Where the velocity ratio is below the predetermined amount, the system is open and fluid flow is relatively unimpeded. As the velocity of fluid flow changes over time, the valve will open or close in response. A flow ratio control passageway can be designed to provide a greater rate of increase in resistance to flow as a function of increased velocity above a target velocity in comparison to the other passageway. Alternately, a passageway can be designed to provide a lesser rate of increase in resistance to fluid flow as a function of fluid velocity above a targeted velocity in comparison to the other passageway.

Figure 17A:
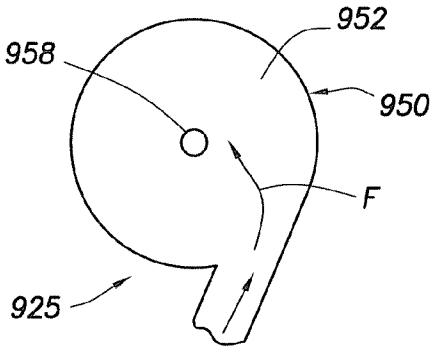
FIG. 17A-C are schematic views of an embodiment of a pathway dependent resistance systems of the invention, indicating varying flow rate over time.
Figure 17B:
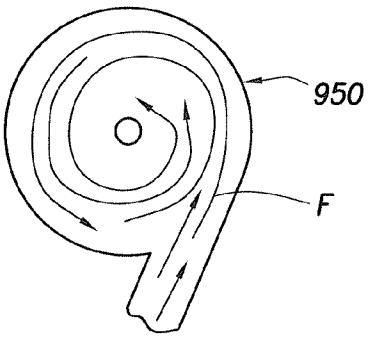
Figure 17C:
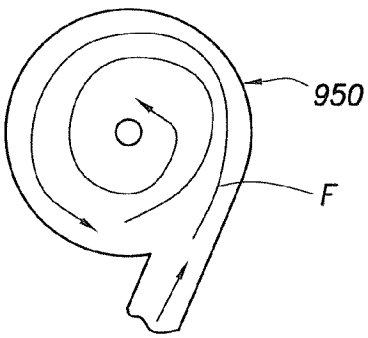

Another embodiment of a velocity based fluid valve is seen at FIGS. 17A-C, in which a fluid pathway dependent resistance system 950 is used to create a bistable switch. The pathway dependent resistance system 950 preferably has only a single inlet 954 and single outlet 958 in this embodiment, although other inlets and outlets can be added to regulate flow, flow direction, eliminate eddies, etc. When the fluid flows at below a preselected velocity or flow rate, the fluid tends to simply flow through the vortex outlet 958 without substantial rotation about the vortex chamber 952 and without creating a significant pressure drop across the pathway dependent resistance system 50 as seen in FIG. 17A. As velocity or flow rate increases to above a preselected velocity, as seen in FIG. 17B, the fluid rotates about the vortex chamber 952 before exiting through outlet 958, thereby creating a greater pressure drop across the system. The bistable vortex switch is then closed. As the velocity or flow rate decreases, as represented in FIG. 17C, the fluid continues to rotate about the vortex chamber 952 and continue to have a significant pressure drop. The pressure drop across the system creates a corresponding back-pressure on the fluid upstream. When the velocity or flow rate drops sufficiently, the fluid will return to the flow pattern seen in FIG. 17A and the switch will re-open. It is expected that a hysteresis effect will occur.

Such application of a bistable switch allows fluid control based on changes in the fluid characteristic of velocity or flow rate. Such control is useful in applications where it is desirable to maintain production or injection velocity or flow rate at or below a given rate. Further application will be apparent to those skilled in the art.

The flow control systems as described herein may also utilize changes in the density of the fluid over time to control fluid flow. The autonomous systems and valves described herein rely upon changes in a characteristic of the fluid flow. As described above, fluid viscosity and flow rate can be the fluid characteristic utilized to control flow. In an example system designed to take advantage of changes in the fluid characteristic of density, a flow control system as seen in FIG. 3 provides a fluid ratio system 40 which employs at least two passageways 44 and 46 wherein one passageway is more density dependent than the other. That is, passageway 44 supplies a greater resistance to flow for a fluid having a greater density whereas the other passageway 46 is either substantially density independent or has an inverse flow relationship to density. In such a way, as the fluid changes to a preselected density it is "selected" for production and flows with relatively less resistance through the entire system 25 with less imparted back-pressure; that is, the system or valve will be "open." Conversely, as the density changes over time to an undesirable density, the flow ratio control system 40 will change the output ratio and the system 25 will impart a relatively greater back-pressure; that is, the valve is "closed."

Other flow control system arrangements can be utilized with a density dependent embodiment as well. Such arrangements include the addition of amplifier systems, pathway dependent resistance systems and the like as explained elsewhere herein. Further, density dependent systems may utilize bistable switches and other fluidic control devices herein.

In such a system, fluid is "selected" or the fluid selector valve is open where the fluid density is above or below a preselected density. For example, a system designed to select production of fluid when it is composed of a relatively greater percentage of oil, is designed to select production of the fluid, or be open, when the fluid is above a target density. Conversely, when the density of the fluid drops below the target density, the system is designed to be closed. When the density dips below the preselected density, the switch is "flipped" closed and fluid flow is resisted.

The density dependent flow control system can utilize fluid amplifiers as described above in relation to fluid viscosity dependent flow control systems, such as seen in FIG. 12. In one embodiment of a density dependent autonomous flow control system, a system utilizing a fluid ratio system, similar to that shown at ratio control system 140 in FIG. 5, is used. The ratio control system passageways 144 and 146 are modified, as necessary, to divide the fluid flow based on relative fluid density (rather than relative viscosity). A primary passageway 147 can be used if desired. The ratio control system in this embodiment divides the flow into a ratio based on fluid density. Where the density ratio is above (or below) a preselected ratio, the selector system is closed and resists flow. As the density of fluid flow changes over time, the valve will open or close in response.

The velocity dependent systems described above can be utilized in the steam injection method where there are multiple injection ports fed from the same steam supply line. Often during steam injection, a "thief zone" is encountered which bleeds a disproportionate amount of steam from the injection system. It is desirable to limit the amount of steam injected into the thief zone so that all of the zones fed by a steam supply receive appropriate amounts of steam.

Turning again to FIG. 16, an injection well 1200 with steam source 1201 and steam supply line(s) 1206 supplying steam to multiple injection port systems 1210 is utilized. The flow control systems 1225 are velocity dependent systems, as described above. The injection steam is supplied from the supply line 1206 to the ports 1210 and thence into the formation 1204. The steam is injected through the velocity dependent flow control system, such as a bistable switch 170, seen in FIG. 5, at a preselected "low" rate at which the switch does not exhibit bistability. The steam simply flows into the outlets 184 and 186 in basically similar proportion. The outlets 184 and 186 are in fluid communication with the inlets 154 and 156 of the pathway dependent resistance system. The pathway dependent resistance system 150 will thus not create a significant back-pressure on the steam which will enter the formation with relatively ease.

If a thief zone is encountered, the steam flow rate through the flow control system will increase above the preselected low injection rate to a relatively high rate. The increased flow rate of the steam through the bistable switch will cause the switch to become bistable. That is, the switch 170 will force a disproportionate amount of the steam flow through the bistable switch outlet 184 and into the pathway dependent resistance system 150 through the primarily tangentially-oriented inlet 154. Thus the steam injection rate into the thief zone will be restricted by the autonomous fluid selectors. (Alternately, the velocity dependent flow control systems can utilize the pathway dependent resistance system shown at FIG. 17 or other velocity dependent systems described elsewhere to similar effect.)

It is expected that a hysteresis effect will occur. As the flow rate of the steam increases and creates bistability in the switch 170, the flow rate through the flow control system 125 will be restricted by the back-pressure created by the pathway dependent resistance system 140. This, in turn, will reduce the flow rate to the preselected low rate, at which time the bistable switch will cease to function, and steam will again flow relatively evenly through the vortex inlets and into the formation without restriction.

The hysteresis effect may result in "pulsing" during injection. Pulsing during injection can lead to better penetration of pore space since the transient pulsing will be pushing against the inertia of the surrounding fluid and the pathways into the tighter pore space may become the path of least resistance. This is an added benefit to the design where the pulsing is at the appropriate rate.

To "re-set" the system, or return to the initial flow pattern, the operator reduces or stops steam flow into the supply line. The steam supply is then re-established and the bistable switches are back to their initial condition without bistability. The process, can be repeated as needed.

In some places, it is advantageous to have an autonomous flow control system or valve that restricts production of injection fluid as it starts to break-through into the production well, however, once the break-through has occurred across the entire well, the autonomous fluid selector valve turns off. In other words, the autonomous fluid selector valve restricts water production in the production well until the point is reached where that restriction is hurting oil production from the formation. Once that point is reached, the flow control system ceases restricting production into the production well.

In FIG. 16, concentrating on the production well 1300, the production tubing string 1308 has a plurality of production tubular sections 24, each with at least one autonomous flow control system 25.

Figure 18:
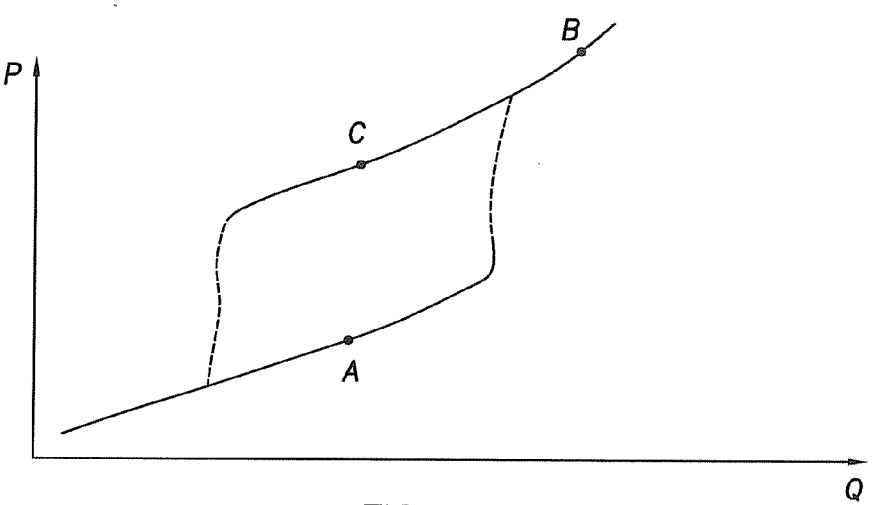
FIG. 18 is a chart of pressure versus flow rate and indicating the hysteresis effect expected from the variance in flow rate over time in the system of FIG. 17.

In one embodiment, the autonomous flow control system functions as a bistable switch, such as seen in FIG. 17 at bistable switch 950. The bistable fluid switch 950 creates a region where different pressure drops can be found for the same flow rate. FIG. 18 is a chart of pressure P versus flow rate Q illustrating the flow through bistable switch, pathway dependent resistance system 950. At fluid flow rate increases at region A, the pressure drop across the system gradually increases. When the flow rate increases to a preselected rate, the pressure will jump, as seen at region B. As the increased pressure leads to reduced flow rate, the pressure will stay relatively high, as seen at region C. If the flow rate drops enough, the pressure will drop significantly and the cycle can begin again. In practice the benefit of this hysteresis effect is that if the operator knows what final position he wants the switch to be in, he can achieve it, by either starting with a very slow flow rate and gradually increasing it to the desired level, or, starting with a very high flow rate and gradually decreasing it to the desired level.

Figure 19:
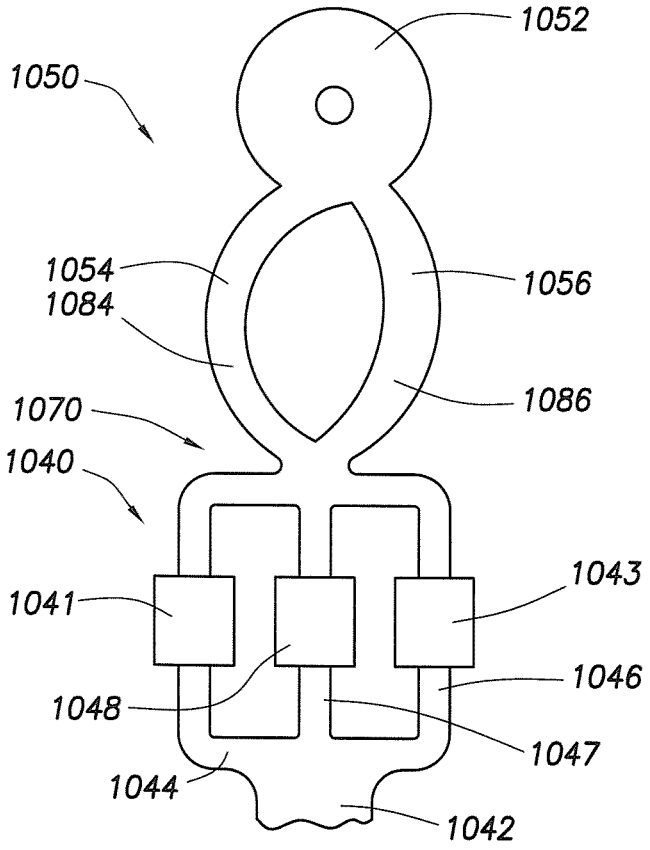
FIG. 19 is a schematic drawing showing a flow control system according to one embodiment of the invention having a ratio control system, amplifier system and pathway dependent resistance system, exemplary for use in inflow control device replacement.

FIG. 19 is a schematic drawing showing a flow control system according to one embodiment of the invention having a ratio control system, amplifier system and pathway dependent resistance system, exemplary for use in inflow control device replacement. Inflow Control Devices (ICD), such as commercially available from Halliburton Energy Services, Inc., under the trade name EquiFlow, for example. Influx from the reservoir varies, sometimes rushing to an early breakthrough and other times slowing to a delay. Either condition needs to be regulated so that valuable reserves can be fully recovered. Some wells experience a "heel-toe" effect, permeability differences and water challenges, especially in high viscosity oil reserves. An ICD attempts to balance inflow or production across the completion string, improving productivity, performance and efficiency, by achieving consistent flow along each production interval. An ICD typically moderates flow from high productivity zones and stimulates flow from lower productivity zones. A typical ICD is installed and combined with a sand screen in an unconsolidated reservoir. The reservoir fluid runs from the formation through the sand screen and into the flow chamber, where it continues through one or more tubes. Tube lengths and inner diameters are designed to induce the appropriate pressure drop to move the flow through the pipe at a steady pace. The ICD equalizes the pressure drop, yielding a more efficient completion and adding to the producing life as a result of delayed water-gas coning. Production per unit length is also enhanced.

The flow control system of FIG. 19 is similar to that of FIGS. 5, 10 and 12 and so will not be discussed in detail. The flow control system shown in FIG. 19 is velocity dependent or flow rate dependent. The ratio control system 1040 has first passageway 1044 with first fluid flow restrictor 1041 therein and a second inlet passageways 1046 with a second flow restrictor 1043 therein. A primary passageway 1047 can be utilized as well and can also have a flow restriction 1048. The restrictions in the passageways are designed to produce different pressure drops across the restrictions as the fluid flow rate changes over time. The flow restrictor in the primary passageway can be selected to provide the same pressure drops over the same flow rates as the restrictor in the first or second passageway.

Figure 20:
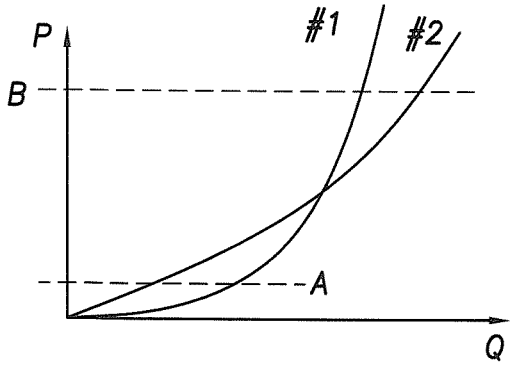
FIG. 20 is a chart of pressure, P, versus flow rate, Q, showing the behavior of the flow passageways in FIG. 19.

FIG. 20 is a chart indicating the pressure, P, versus flow rate, Q, curves for the first passageway 1044 (#1) and second passageway 1046 (#2), each with selected restrictors. At a low driving pressure, line A, there will be more fluid flow in the first passageway 1044 and proportionately less fluid flow in the second passageway 1046. Consequently, the fluid flow leaving the amplifier system will be biased toward outlet 1086 and into the vortex chamber 1052 through radial inlet 1056. The fluid will not rotate substantially in the vortex chamber and the valve will be open, allowing flow without imparting substantial back-pressure. At a high driving pressure, such as at line B, the proportionate fluid flow through the first and second passageways will reverse and fluid will be directed into the vortex chamber primarily tangentially creating a relatively large pressure drop, imparting back-pressure to the fluid and closing the valve.

In a preferred embodiment where production is sought to be limited at higher driving pressures, the primary passageway restrictor is preferably selected to mimic the behavior of the restrictor in the first passageway 1044. Where the restriction 1048 behaves in a manner similar to restrictor 1041, the restriction 1048 allows less fluid flow at the high pressure drops, thereby restricting fluid flow through the system.

The flow restrictors can be orifices, viscous tubes, vortex diodes, etc. Alternately, the restrictions can be provided by spring biased members or pressure-sensitive components as known in the art. In the preferred embodiment, restriction 1041 in the first passageway 1044 has flexible "whiskers" which block flow at a low driving pressure but bend out of the way at a high pressure drop and allow flow.

This design for use as an ICD provides greater resistance to flow once a specified flow rate is reached, essentially allowing the designer to pick the top rate through the tubing string section.

Figure 21:
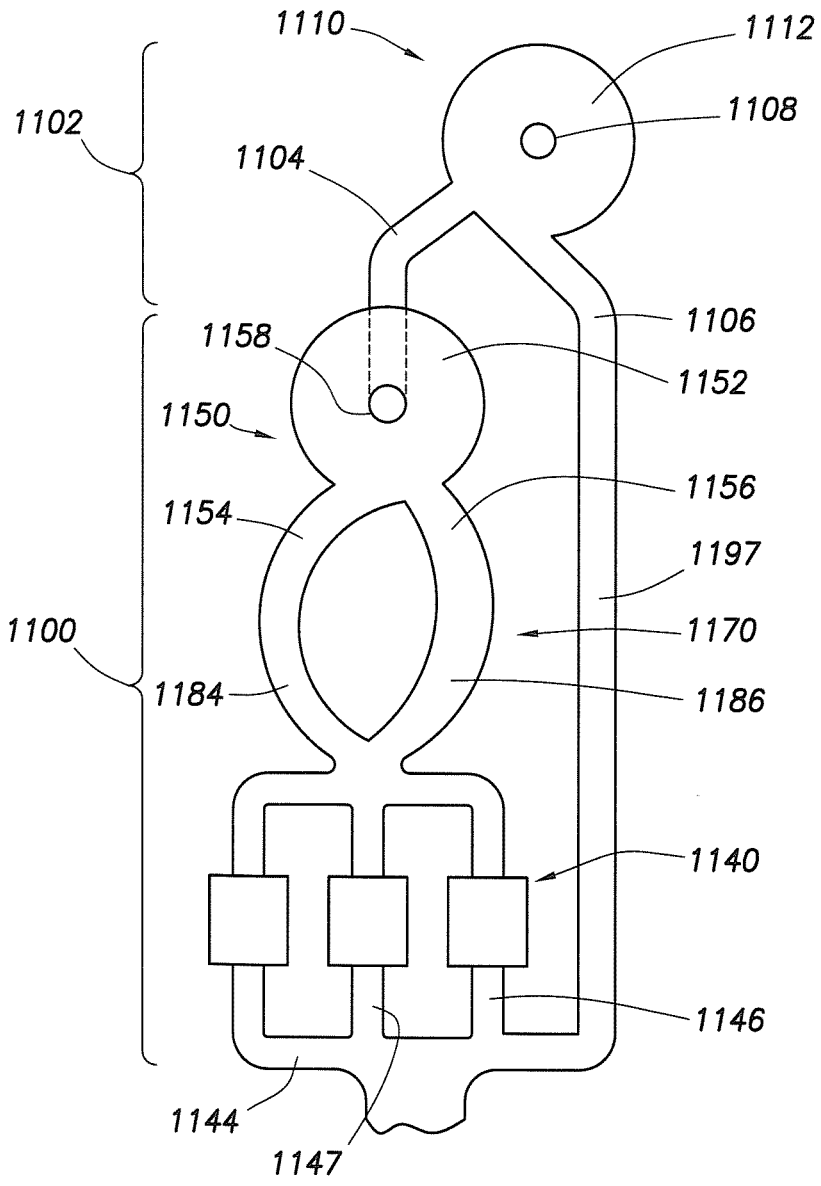
FIG. 21 is a schematic showing an embodiment of a flow control system according to the invention having multiple valves in series, with an auxiliary flow passageway and a secondary pathway dependent resistance system.

FIG. 21 shows an embodiment of a flow control system according to the invention having multiple valves in series, with an auxiliary flow passageway and secondary pathway dependent resistance system.

A first fluid selector valve system 1100 is arranged in series with a second fluidic valve system 1102. The first flow control system 1100 is similar to those described herein and will not be described in detail. The first fluid selector valve includes a flow ratio control system 1140 with first, second and primary passageways 1144, 1146 and 1147, a fluid amplifier system 1170, and a pathway dependent resistance system 1150, namely, a pathway dependent resistance system with vortex chamber 1152 and outlet 1158. The second fluidic valve system 1102 in the preferred embodiment shown has a selective pathway dependent resistance system 1110, in this case a pathway dependent resistance system. The pathway dependent resistance system 1110 has a radial inlet 1104 and tangential inlet 1106 and outlet 1108.

When a fluid having preferred viscosity (or flow rate) characteristics, to be selected, is flowing through the system, then the first flow control system will behave in an open manner, allowing fluid flow without substantial back-pressure being created, with fluid flowing through the pathway dependent resistance system 1150 of the first valve system primarily radially. Thus, minimal pressure drop will occur across the first valve system. Further, the fluid leaving the first valve system and entering the second valve system through radial inlet 1104 will create a substantially radial flow pattern in the vortex chamber 1112 of the second valve system. A minimal pressure drop will occur across the second valve system as well. This two-step series of autonomous fluid selector valve systems allows for looser tolerance and a wider outlet opening in the pathway dependent resistance system 1150 of the first valve system 1100.

The inlet 1104 receives fluid from auxiliary passageway 1197 which is shown fluidly connected to the same fluid source 1142 as the first autonomous valve system 1100. Alternately, the auxiliary passageway 1197 can be in fluid communication with a different fluid source, such as fluid from a separate production zone along a production tubular. Such an arrangement would allow the fluid flow rate at one zone to control fluid flow in a separate zone. Alternatively, the auxiliary passageway can be fluid flowing from a lateral borehole while the fluid source for the first valve system 1100 is received from a flow line to the surface. Other arrangements will be apparent. It should be obvious that the auxiliary passageway can be used as the control input and the tangential and radial vortex inlets can be reversed. Other alternatives can be employed as described elsewhere herein, such as addition or subtraction of amplifier systems, flow ratio control modifications, vortex modifications and substitutes, etc.

Figure 22:
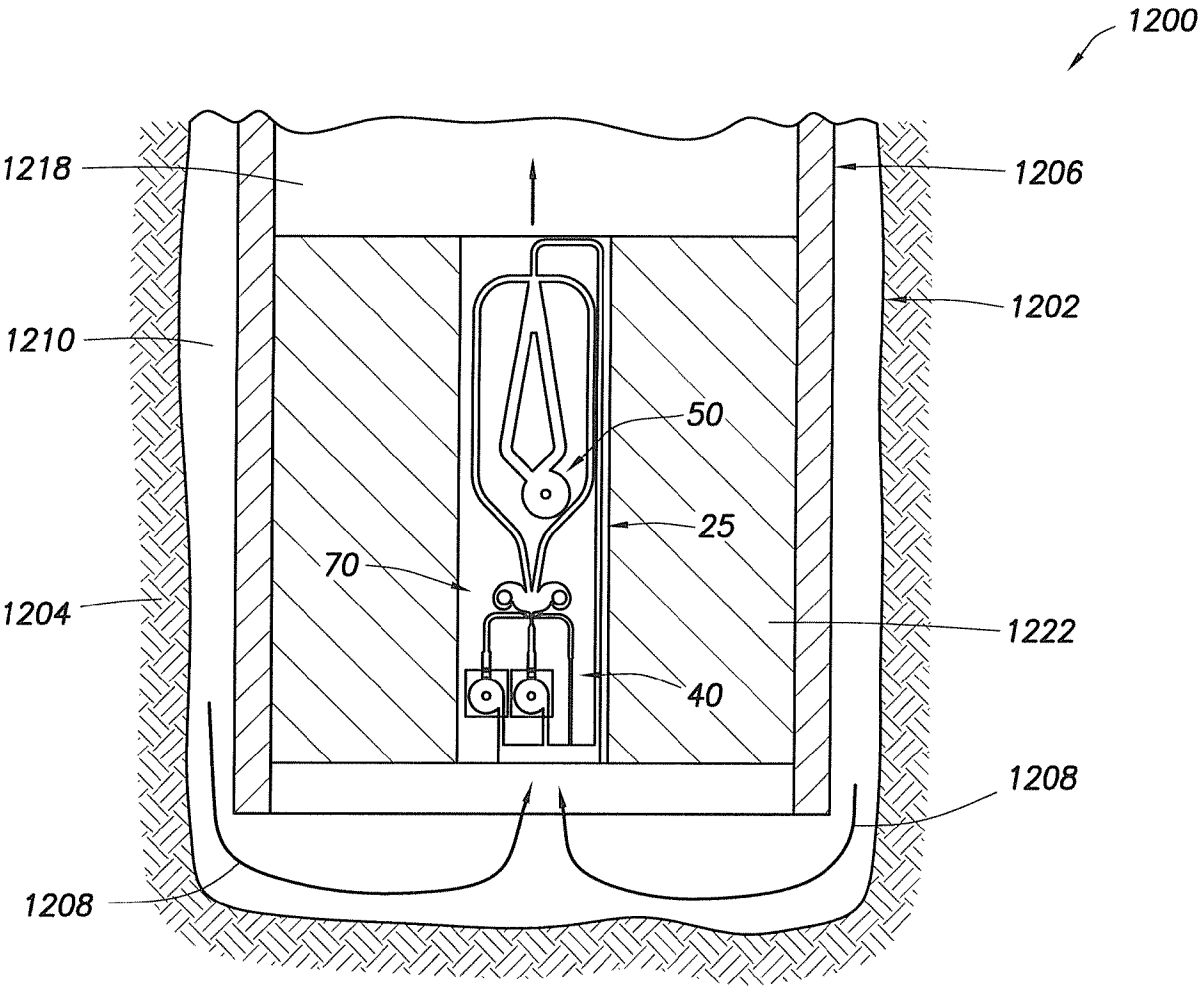
FIG. 22 shows a schematic of a flow control system in accordance with the invention for use in reverse cementing operations in a tubular extending into a wellbore.

FIG. 22 is a schematic of a reverse cementing system 1200. The wellbore 1202 extends into a subterranean formation 1204. A cementing string 1206 extends into the wellbore 1202, typically inside a casing. The cementing string 1206 can be of any kind known in the art or discovered later capable of supplying cement into the wellbore in a reverse cementing procedure. During reverse cementing, the cement 1208 is pumped into the annulus 1210 formed between the wall of the wellbore 1202 and the cementing string 1206. The cement, flow of which is indicated by arrows 1208, is pumped into the annulus 1210 at an uphole location and downward through the annulus toward the bottom of the wellbore. The annulus thus fills from the top downward. During the procedure, the flow of cement and pumping fluid 1208, typically water or brine, is circulated down the annulus to the bottom of the cementing string, and then back upward through the interior passageway 1218 of the string.

FIG. 22 shows a flow control system 25 mounted at or near the bottom of the cement string 1206 and selectively allowing fluid flow from outside the cementing string into the interior passageway 1218 of the cement string. The flow control system 25 is of a design similar to that explained herein in relation to FIG. 3, FIG. 5, FIG. 10 or FIG. 12. The flow control system 25 includes a ratio control system 40 and a pathway dependent resistance system 50. Preferably the system 25 includes at least one fluid amplifier system 70. The plug 1222 seals flow except for through the autonomous fluid selector valve.

The flow control system 25 is designed to be open, with the fluid directed primarily through the radial inlet of the pathway dependent resistance system 50, when a lower viscosity fluid, such as pumping fluid, such as brine, is flowing through the system 25. As the viscosity of the fluid changes as cement makes its way down to the bottom of the wellbore and cement begins to flow through the flow control system 25, the selector system closes, directing the now higher viscosity fluid (cement) through the tangential inlet of the pathway dependent resistance system 50. Brine and water flows easily through the selector system since the valve is open when such fluids are flowing through the system. The higher viscosity cement (or other non-selected fluid) will cause the valve to close and measurably increase the pressure read at the surface.

In an alternate embodiment, multiple flow control systems in parallel are employed. Further, although the preferred embodiment has all fluid directed through a single flow control system, a partial flow from the exterior of the cement string could be directed through the fluid selector.

For added pressure increase, the plug 1222 can be mounted on a sealing or closing mechanism that seals the end of the cement string when cement flow increases the pressure drop across the plug. For example, the flow control system or systems can be mounted on a closing or sealing mechanism, such as a piston-cylinder system, flapper valve, ball valve or the like in which increased pressure closes the mechanism components. As above, the selector valve is open where the fluid is of a selected viscosity, such as brine, and little pressure drop occurs across the plug. When the closing mechanism is initially in an open position, the fluid flows through and past the closing mechanism and upwards through the interior passageway of the string. When the closing mechanism is moved to a closed position, fluid is prevented from flowing into the interior passageway from outside the string. When the mechanism is in the closed position, all of the pumping fluid or cement is directed through the flow control system 25.

When the fluid changes to a higher viscosity, a greater back-pressure is created on the fluid below the selector system 25. This pressure is then transferred to the closing mechanism. This increased pressure moves the closing mechanism to the closed position. Cement is thus prevented from flowing into the interior passageway of the cement string.

In another alternative, a pressure sensor system can be employed. When the fluid moving through the fluid amplifier system changes to a higher viscosity, due to the presence of cement in the fluid, the flow control system creates a greater back-pressure on the fluid as described above. This pressure increase is measured by the pressure sensor system and read at the surface. The operator then stops pumping cement knowing that the cement has filled the annulus and reached the bottom of the cement string.

Figure 23:
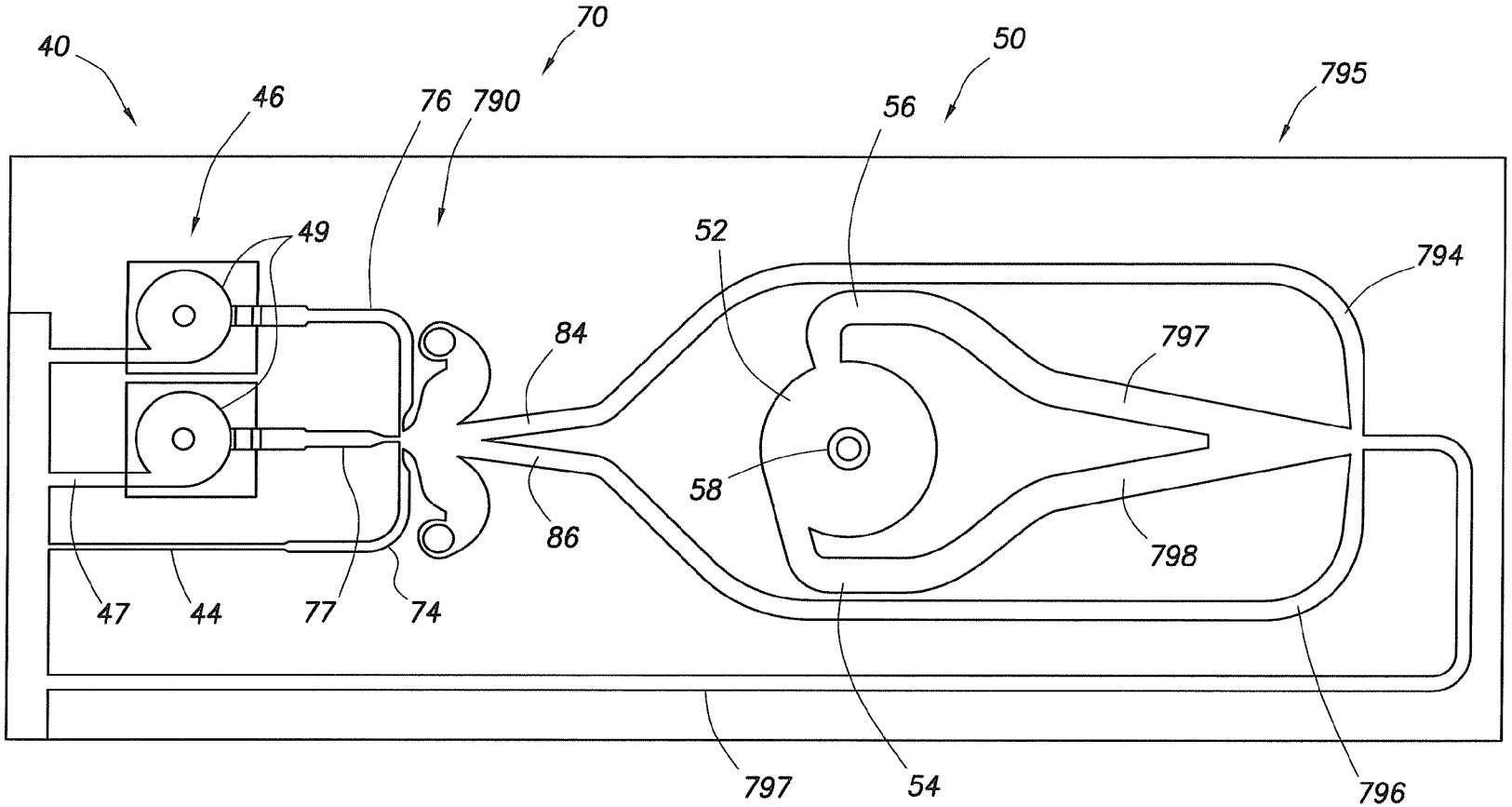
FIG. 23 shows a schematic of a flow control system in accordance with the invention.

FIG. 23 shows a schematic view of a preferred embodiment of the invention. Note that the two inlets 54 and 56 to the vortex chamber 52 are not perfectly aligned to direct fluid flow perfectly tangentially (i.e., exactly 90 degrees to a radial line from the vortex center) nor perfectly radially (i.e., directly towards the center of the vortex), respectively. Instead, the two inlets 54 and 56 are directed in a rotation maximizing pathway and a rotation minimizing pathway, respectively. In many respects, FIG. 23 is similar to FIG. 12 and so will not be described at length here. Like numbers are used to FIG. 12. Optimizing the arrangements of the vortex inlets is a step that can be carried out using, for example, Computational Flow Dynamics models.

Figure 24A:
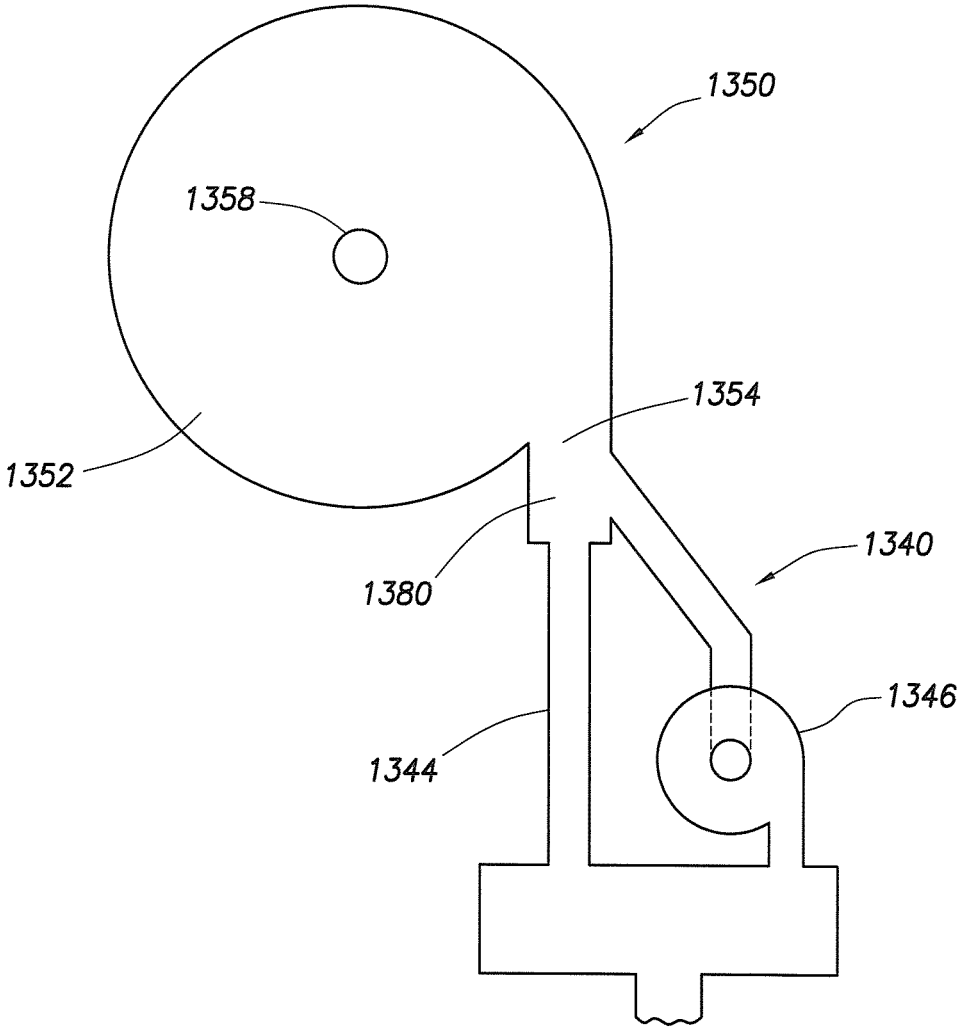
FIG. 24A-D shows schematic representational views of four alternate embodiments of a pathway dependent resistance system of the invention.

FIGS. 24A-D shows other embodiments of the inventive pathway dependent resistance system. FIG. 24A shows a pathway dependent resistance system with only one passageway 1354 entering the vortex chamber. The flow control system 1340 changes the entrance angle of the fluid as it enters the chamber 1352 from this single passageway. Fluid flow F through the fluid ratio controller passageways 1344 and 1346 will cause a different direction of the fluid jet at the outlet 1380 of the fluid ratio controller 1340. The angle of the jet will either cause rotation or will minimize rotation in the vortex chamber 1350 by the fluid before it exits the chamber at outlet 1358.

Figure 24B:
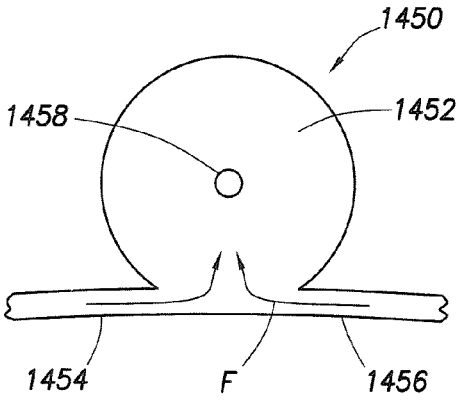
Figure 24C:
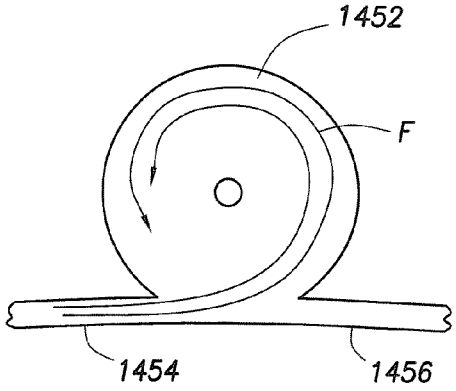

FIG. 24B-C is another embodiment of the pathway dependent resistance system 1450, in which the two inlet passageways both enter the vortex chamber primarily tangentially. When the flow is balanced between the passages 1454 and 1456, as shown in FIG. 24B, the resulting flow in the vortex chamber 1452 has minimal rotation before exiting outlet 1458. When the flow down one of the passageways is greater than the flow down the other passage way, as shown in FIG. 24C, the resulting flow in the vortex chamber 1452 will have substantial rotation prior to flowing through outlet 1458. The rotation in the flow creates back pressure on the fluid upstream in the system. Surface features, exit path orientation, and other fluid path features can be used to cause more flow resistance to one direction of rotation (such as counter-clockwise rotation) than to another direction of rotation (such as clockwise rotation).

Figure 24D:
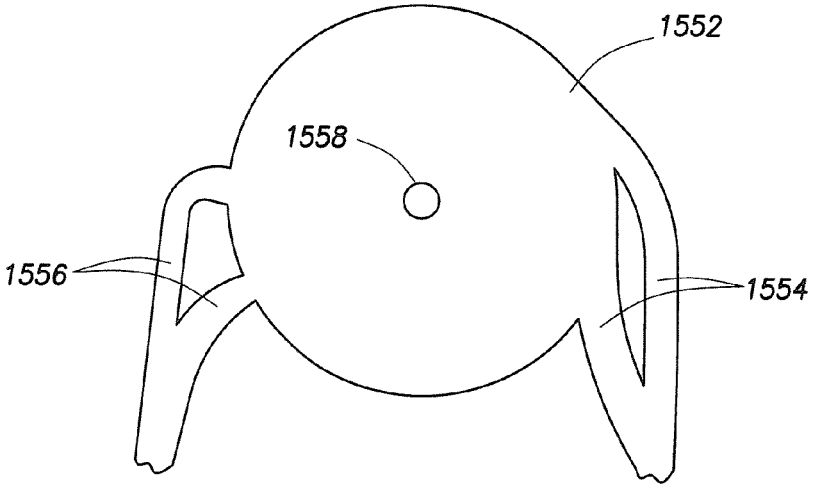

In FIG. 24D, multiple inlet tangential paths 1554 and multiple inlet radial paths 1556 are used to minimize the flow jet interference to the inlet of the vortex chamber 1552 in pathway dependent resistance system 1550. Thus, the radial path can be split into multiple radial inlet paths directed into the vortex chamber 1552. Similarly, the tangential path can be divided into multiple tangential inlet paths. The resultant fluid flow in the vortex chamber 1552 is determined at least in part by the entry angles of the multiple inlets. The system can be selectively designed to create more or less rotation of the fluid about the chamber 1552 prior to exiting through outlet 1558.

Note that in the fluid flow control systems described herein, the fluid flow in the systems is divided and merged into various streams of flow, but that the fluid is not separated into its constituent components; that is, the flow control systems are not fluid separators.

For example, where the fluid is primarily natural gas, the flow ratio between the first and second passageways may reach 2:1 since the first passageway provides relatively little resistance to the flow of natural gas. The flow ratio will lower, or even reverse, as the proportional amounts of the fluid components change. The same passageways may result in a 1:1 or even a 1:2 flow ratio where the fluid is primarily oil. Where the fluid has both oil and natural gas components the ratio will fall somewhere in between. As the proportion of the components of the fluid change over the life of the well, the flow ratio through the ratio control system will change. Similarly, the ratio will change if the fluid has both water and oil components based on the relative characteristic of the water and oil components. Consequently, the fluid ratio control system can be designed to result in the desired fluid flow ratio.

The flow control system is arranged to direct flow of fluid having a larger proportion of undesired component, such as natural gas or water, into the vortex chamber primarily tangentially, thereby creating a greater back-pressure on the fluid than if it was allowed to flow upstream without passing through the vortex chamber. This back-pressure will result in a lower production rate of the fluid from the formation along the production interval than would occur otherwise.

For example, in an oil well, natural gas production is undesired. As the proportion of natural gas in the fluid increases, thereby reducing the viscosity of the fluid, a greater proportion of fluid is directed into the vortex chamber through the tangential inlet. The vortex chamber imparts a back-pressure on the fluid thereby restricting flow of the fluid. As the proportion of fluid components being produced changes to a higher proportion of oil (for example, as a result of oil in the formation reversing a gas draw-down), the viscosity of the fluid will increase. The fluid ratio system will, in response to the characteristic change, lower or reverse the ratio of fluid flow through its first and second passageways. As a result, a greater proportion of the fluid will be directed primarily radially into the vortex chamber. The vortex chamber offers less resistance and creates less back-pressure on fluid entering the chamber primarily radially.

The above example refers to restricting natural gas production where oil production is desired. The invention can also be applied to restrict water production where oil production is desired, or to restrict water production when gas production is desired.

The flow control system offers the advantage of operating autonomously in the well. Further, the system has no moving parts, as it is made of only fixed parts, and is therefore not susceptible to being "stuck" as fluid control systems with mechanical valves and the like. Further, the flow control system will operate regardless of the orientation of the system in the wellbore, so the tubular containing the system need riot be oriented in the wellbore. The system will operate in a vertical or deviated wellbore.

While the preferred flow control system is completely autonomous, neither the inventive flow direction control system nor the inventive pathway dependent resistance system necessarily have to be combined with the preferred embodiment of the other. So one system or the other could have moving parts, or electronic controls, etc.

For example, while the pathway dependent resistance system is preferably based on a vortex chamber, it could be designed and built to have moving portions, to work with the ratio control system. To wit, two outputs from the ratio control system could connect to either side of a pressure balanced piston, thereby causing the piston to be able to shift from one position to another. One position would, for instance, cover an exit port, and one position would open it. Hence, the ratio control system does not have to have a vortex-based system to allow one to enjoy the benefit of the inventive ratio control system. Similarly, the inventive pathway dependent resistance system could be utilized with a more traditional actuation system, including sensors and valves. The inventive systems could also include data output subsystems, to send data to the surface, to allow operators to see the status of the system.

The invention can also be used with other flow control systems, such as inflow control devices, sliding sleeves, and other flow control devices that are already well known in the industry. The inventive system can be either parallel with or in series with these other flow control systems.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. An apparatus for autonomously controlling flow of fluid comprising:

a pathway dependent resistance system; and a flow ratio control system for controlling the pathway dependent resistance system, an output of the flow ratio control system in fluid communication with at least an input of the pathway dependent resistance system, the flow ratio control system having at least a first passageway and a second passageway for defining a ratio of fluid flow through the first passageway and second passageway, the ratio of fluid flow autonomously responsive to change in a characteristic of the fluid flow, wherein the characteristic is viscosity, wherein the first passageway of the fluid ratio control system is more viscosity-dependent than the second passageway, and wherein the first passageway is made of a swellable material, the passageway constricting when the material swells.

2. The apparatus as in claim 1 wherein the swellable material swells when contacted by the fluid when an undesired component is present in the fluid.

3. An apparatus for autonomously controlling flow of fluid comprising:

a pathway dependent resistance system; and a flow ratio control system for controlling the pathway dependent resistance system, an output of the flow ratio control system in fluid communication with at least an input of the pathway dependent resistance system, the flow ratio control system having at least a first passageway and a second passageway for defining a ratio of fluid flow through the first passageway and second passageway, the ratio of fluid flow autonomously responsive to change in a characteristic of the fluid flow, further comprising a fluid amplifier system interposed between the fluid ratio control system and the pathway dependent resistance system and in fluid communication with both, wherein the fluid ratio control system further comprises a primary flow passageway, the primary flow passageway in fluid communication with the fluid amplifier system, and wherein the primary passageway further comprises a vortex diode.

4. The apparatus as in claim 3 wherein the primary passageway will accommodate more fluid flow than either the first or second passageways.

5. The apparatus as in claim 3 wherein the primary passageway will accommodate more flow than the first and second passageways combined.

6. The apparatus as in claim 3 wherein the first and second passageways of the flow ratio control system will direct flow from the primary passageway.

7. The apparatus as in claim 3 further comprising multiple fluid amplifier systems interposed between the fluid ratio control system and the pathway dependent resistance system, the fluid amplifier systems arranged in series.

8. The apparatus as in claim 7 wherein the multiple fluid amplifier systems comprise at least one proportional amplifier and at least one bistable amplifier.

9. The apparatus as in claim 7 wherein the multiple fluid amplifier systems comprise at least one pressure-type amplifier and at least one bistable amplifier.

10. An apparatus for autonomously controlling flow of fluid comprising:

a pathway dependent resistance system; and a flow ratio control system of only fixed parts for controlling the pathway dependent resistance system, an output of the flow ratio control system in fluid communication with at least an input of the pathway dependent resistance system, the flow ratio control system having at least a first passageway and a second passageway for defining a ratio of fluid flow through the first passageway and second passageway, the ratio of fluid flow autonomously responsive to change in a characteristic of the fluid flow;

a downhole oilfield tubular for positioning downhole in a wellbore extending through a subterranean formation and wherein the flow ratio control system is positioned in the tubular;

the apparatus for injecting steam as injection fluid from the oilfield tubular into the formation and for controlling injection of the injection fluid into the formation; and wherein the apparatus selects injection of steam over injection of water.

11. The apparatus as in claim 10, wherein the apparatus will provide lower resistance to flow as the composition of the injection fluid changes to a higher percentage of steam.

12. An apparatus for autonomously controlling flow of fluid comprising:

a pathway dependent resistance system; and a flow ratio control system of only fixed parts for controlling the pathway dependent resistance system, an output of the flow ratio control system in fluid communication with at least an input of the pathway dependent resistance system, the flow ratio control system having at least a first passageway and a second passageway for defining a ratio of fluid flow through the first passageway and second passageway, the ratio of fluid flow autonomously responsive to a characteristic of the fluid flow; and further comprising a downhole oilfield tubular for positioning downhole in a wellbore extending through a subterranean formation and wherein the flow ratio control system is positioned in the tubular, wherein the apparatus is for controlling flow of cementing fluid from the exterior of the oilfield tubular to the interior of the oilfield tubular during reverse cementing; and wherein the apparatus will provide higher resistance to flow of cementing fluid as the composition of the cementing fluid changes to a higher viscosity.

13. An apparatus for autonomously controlling flow of fluid comprising:

a pathway dependent resistance system; and a flow ratio control system for controlling the pathway dependent resistance system, an output of the flow ratio control system in fluid communication with at least an input of the pathway dependent resistance system, the flow ratio control system having at least a first passageway and a second passageway for defining a ratio of fluid flow through the first passageway and second passageway, the ratio of fluid flow autonomously responsive to a characteristic of the fluid flow; and further comprising a downhole oilfield tubular for positioning downhole in a wellbore extending through a subterranean formation and wherein the flow ratio control system is positioned in the tubular; and wherein the flow ratio control system and pathway dependent resistance system are positioned within a movable plug.

14. A system for controlling fluid flow comprising:

a pathway dependent resistance system, having a vortex chamber; at least a first inlet; and an outlet; and wherein at least the first inlet of the pathway dependent resistance system is in fluid communication with a flow direction control system, the flow from the flow direction control system affecting direction flow takes into the pathway dependent resistance system, and wherein the direction fluid flow takes into the pathway dependent resistance system is dependent on fluid viscosity and autonomously changes in response to fluid viscosity changes; and wherein the pathway dependent resistance system is positioned in an oilfield tubular for positioning downhole in a wellbore extending through a subterranean formation.

15. The apparatus as in claim 14, wherein the pathway dependent resistance system is for controlling production fluid flow and wherein the apparatus selects natural gas production over water production.

16. The apparatus as in claim 14, wherein the pathway dependent resistance system is for controlling production fluid flow and wherein the apparatus selects oil production over water production.

17. The apparatus as in claim 14, wherein the pathway dependent resistance system is for controlling production fluid flow and wherein the apparatus selects oil production over natural gas production.

18. The apparatus as in claim 14, wherein the pathway dependent resistance system is for controlling the injection of injection fluid into the formation.

19. The apparatus as in claim 18, wherein the injection fluid is steam.

20. The apparatus as in claim 19, wherein the pathway dependent resistance system selects injection of steam over injection of water.

21. The apparatus as in claim 20, wherein the pathway dependent resistance system provides lower resistance to flow as the composition of the injection fluid changes to a higher percentage of steam.

22. A flow control system, comprising:

a flow ratio control system having at least a first passageway and a second passageway, wherein the ratio of fluid flow through the first passageway and second passageway is related to a characteristic of the fluid flow; and a pathway dependent resistance system having a vortex chamber with at least a first inlet and an outlet, the first inlet of the pathway dependent resistance system in fluid communication with either the first or second passageway or both of the fluid ratio control system, variations in the ratio of flow coming from the first and second passageway affecting the relative resistance of the total fluid moving through the pathway dependent resistance system; and wherein the flow control system is positioned in an oilfield tubular for positioning downhole in a wellbore extending through a subterranean formation.

23. The apparatus as in claim 22, wherein the oilfield tubular has an interior passageway in fluid communication with the flow ratio control system.

24. The apparatus as in claim 23, wherein formation fluid will flow from the formation into the tubular interior passageway.

25. The apparatus as in claim 22, wherein the flow control system is for controlling production fluid flow and wherein the apparatus selects oil production over natural gas production.

26. The apparatus as in claim 25, wherein the flow control system will provide higher resistance to flow as the composition of the formation fluid changes to a higher percentage of natural gas.

27. The apparatus as in claim 22, wherein the flow control system is for controlling production fluid flow and wherein the apparatus selects natural gas production over water production.

28. The apparatus as in claim 22, wherein the flow control system is for controlling production fluid flow and wherein the apparatus selects oil production over water production.

29. The apparatus as in claim 22, further comprising a plurality of flow control systems.

30. The apparatus as in claim 22, the flow control system for controlling injection of injection fluid from the oilfield tubular into the formation.

31. The apparatus as in claim 30, wherein the flow control system selects injection of steam over injection of water.

32. The apparatus as in claim 22, wherein the flow ratio control system controls flow of cementing fluid from the exterior of the oilfield tubular to the interior of the oilfield tubular during reverse cementing.

33. The apparatus as in claim 32, wherein the flow control system will provide higher resistance to flow of cementing fluid as the composition of the cementing fluid changes to a higher viscosity.

34. The apparatus as in claim 32, further comprising a movable plug mounted in an interior passageway of the oil-field tubular and operable to restrict fluid flow into the interior passageway.

35. The apparatus as in claim 32, wherein the flow ratio control system and pathway dependent resistance system are positioned within a movable plug.

36. The apparatus as in claim 22, further comprising a screen assembly for sand control.

37. The apparatus as in claim 22, further comprising an inflow control device in fluid communication with the flow ratio control system.

38. The apparatus as in claim 22, further comprising a plurality of flow control systems spaced along the wellbore.

39. The apparatus as in claim 38, wherein the plurality of flow control systems are positioned in a production string, the production string for extending through the wellbore along a production zone of the formation.

* * * * *